US011749169B2

(12) United States Patent
Zhang et al.

(10) Patent No.: US 11,749,169 B2
(45) Date of Patent: Sep. 5, 2023

(54) DISPLAY PANEL, DRIVING METHOD FOR SAME, AND DISPLAY APPARATUS

(71) Applicants: WUHAN TIANMA MICROELECTRONICS CO., LTD., Wuhan (CN); Wuhan Tianma Microelectronics Co., Ltd. Shanghai Branch, Shanghai (CN)

(72) Inventors: Mengmeng Zhang, Wuhan (CN); Xingyao Zhou, Wuhan (CN); Yue Li, Wuhan (CN); Jian Kuang, Wuhan (CN); Yuantao Wu, Shanghai (CN); Jing Huang, Shanghai (CN)

(73) Assignees: WUHAN TIANMA MICROELECTRONICS CO., LTD., Wuhan (CN); Wuhan Tianma Microelectronics Co., Ltd. Shanghai Branch, Shanghai (CN)

( * ) Notice: Subject to any disclaimer, the term of this patent is extended or adjusted under 35 U.S.C. 154(b) by 0 days.

(21) Appl. No.: 17/864,260

(22) Filed: Jul. 13, 2022

(65) Prior Publication Data

US 2022/0366830 A1 Nov. 17, 2022

(30) Foreign Application Priority Data

Nov. 30, 2021 (CN) ..... 202111444770.1

(51) Int. Cl.
*G09G 3/20* (2006.01)

(52) U.S. Cl.
CPC ... *G09G 3/2092* (2013.01); *G09G 2310/0267* (2013.01); *G09G 2320/0247* (2013.01)

(58) Field of Classification Search
None
See application file for complete search history.

(56) References Cited

U.S. PATENT DOCUMENTS

2018/0166025 A1* 6/2018 Zhou ..... G09G 3/3233
2018/0293942 A1* 10/2018 Gu ..... G09G 3/2022
(Continued)

FOREIGN PATENT DOCUMENTS

CN 103489395 A 1/2014
CN 105788529 A 7/2016
(Continued)

OTHER PUBLICATIONS

Chinese Office Action dated Mar. 10, 2023, issued in related Japanese Application No. 202111444770.1 filed Nov. 30, 2021, 25 pages.

*Primary Examiner* — Chun-Nan Lin
(74) *Attorney, Agent, or Firm* — CHRISTENSEN O'CONNOR JOHNSON KINDNESS PLLC

(57) ABSTRACT

The present disclosure provides a display panel, a driving method, and a display apparatus. The display panel includes pixel circuits, the pixel circuits include: a drive transistor, with a gate electrically connected to a first node, a first electrode electrically connected to a second node; a voltage writing module, electrically connected to a first scanning signal line, a data line, and second node; a threshold compensation module, wherein a driving cycle of the pixel circuit includes a writing phase and a holding phase, writing phase includes a first non-light-emission period, and holding phase includes a second non-light-emission period; voltage writing module writes a display voltage into second node in first non-light-emission period in response to an enable level of first scanning signal, writes a node reset voltage into the second node in the second non-light-emission period in response to the enable level of the first scanning signal.

21 Claims, 12 Drawing Sheets

(56) References Cited

U.S. PATENT DOCUMENTS

| | | | | |
|---|---|---|---|---|
| 2021/0020109 | A1* | 1/2021 | Lin | H01L 27/3262 |
| 2022/0366835 | A1* | 11/2022 | Park | G09G 3/32 |

FOREIGN PATENT DOCUMENTS

| | | | |
|---|---|---|---|
| CN | 111489701 | A | 8/2020 |
| CN | 109461407 | B | 10/2020 |
| CN | 112382235 | A | 2/2021 |
| CN | 113314074 | A | 8/2021 |
| CN | 113325644 | A | 8/2021 |

* cited by examiner

DISPLAY PANEL, DRIVING METHOD FOR SAME, AND DISPLAY APPARATUS

CROSS REFERENCE TO RELATED APPLICATIONS

This application is a continuation of 202111444770.1, filed on Nov. 30, 2021, the content of which is hereby incorporated by reference.

TECHNICAL FIELD

The present disclosure relates to the technical field of display, and in particular, to a display panel, a driving method for same, and a display apparatus.

BACKGROUND

Displaying modes of a display panel include a normal mode and an pidle mode. In the idle mode, the display panel is usually driven at a lower frequency such as 5 Hz, 10 Hz, or 15 Hz, to save power. However, when the display panel is driven at a low frequency, the picture displayed by the display panel is prone to flickering and other undesirable phenomena, and the display appearance is undesirable.

SUMMARY

Accordingly, embodiments of the present disclosure provide a display panel, a driving method for same, and a display apparatus, to effectively solve the problem of picture flickering.

According to an aspect, a display panel is provided, including a plurality of pixel circuits, wherein each of the pixel circuits includes:

a drive transistor, a gate of the drive transistor being electrically connected to a first node, a first electrode of the drive transistor being electrically connected to a second node, and a second electrode of the drive transistor being electrically connected to a third node;

a voltage writing module, electrically connected to a first scanning signal line, a data line, and the second node; and a threshold compensation module, electrically connected a second scanning signal line, the third node, and the first node;

wherein a driving cycle of the pixel circuit includes a writing phase and at least one holding phase, the writing phase includes a first non-light-emission period, and the holding phase includes a second non-light-emission period;

the voltage writing module is configured to write a display voltage into the second node in the first non-light-emission period in response to an enable level of a first scanning signal, and write a node reset voltage into the second node in at least a part of the second non-light-emission period in response to the enable level of the first scanning signal; and the threshold compensation module is configured to compensate a threshold voltage of the drive transistor in the first non-light-emission period in response to an enable level of a second scanning signal.

According to another aspect, based on the same inventive concept, an embodiment of the present disclosure provides a driving method for a display panel, for driving a display panel, the display panel includes a plurality of pixel circuits, wherein each of the pixel circuits includes:

a drive transistor, a gate of the drive transistor being electrically connected to a first node, a first electrode of the drive transistor being electrically connected to a second node, and a second electrode of the drive transistor being electrically connected to a third node; a voltage writing module, electrically connected to a first scanning signal line, a data line, and the second node; and a threshold compensation module, electrically connected to a second scanning signal line, the third node, and the first node;

wherein a driving cycle of the pixel circuit includes a writing phase and at least one holding phase, the writing phase includes a first non-light-emission period, and the holding phase includes a second non-light-emission period; the voltage writing module is configured to write a display voltage into the second node in the first non-light-emission period in response to an enable level of a first scanning signal, and write a node reset voltage into the second node in at least a part of the second non-light-emission period in response to the enable level of the first scanning signal; and the threshold compensation module is configured to compensate a threshold voltage of the drive transistor in the first non-light-emission period in response to an enable level of a second scanning signal.

the driving method includes: driving each of pixel circuits to control a light-emission element to emit light, wherein a driving cycle of the pixel circuit includes a writing phase and at least one holding phase, the writing phase includes a first non-light-emission period, and the holding phase includes a second non-light-emission period;

in the first non-light-emission period, writing, by a voltage writing module, a display voltage into a second node in response to an enable level of a first scanning signal; and compensating, by a threshold compensation module, a threshold voltage of a drive transistor in response to an enable level of a second scanning signal; and in at least a part of the second non-light-emission period, writing, by the voltage writing module, a node reset voltage into the second node in response to the enable level of the first scanning signal. According to further another aspect, based on the same inventive concept, an embodiment of the present disclosure provides a display apparatus, including the display panel includes a plurality of pixel circuits, wherein each of the pixel circuits includes:

a drive transistor, a gate of the drive transistor being electrically connected to a first node, a first electrode of the drive transistor being electrically connected to a second node, and a second electrode of the drive transistor being electrically connected to a third node; a voltage writing module, electrically connected to a first scanning signal line, a data line, and the second node; and a threshold compensation module, electrically connected to a second scanning signal line, the third node, and the first node;

wherein a driving cycle of the pixel circuit includes a writing phase and at least one holding phase, the writing phase includes a first non-light-emission period, and the holding phase includes a second non-light-emission period; the voltage writing module is configured to write a display voltage into the second node in the first non-light-emission period in response to an enable level of a first scanning signal, and write a node reset voltage into the second node in at least a part of the second non-light-emission period in response to the enable level of the first scanning signal; and the threshold compensation module is configured to compensate a threshold voltage of the drive transistor in the first non-light-emission period in response to an enable level of a second scanning signal.

BRIEF DESCRIPTION OF DRAWINGS

To describe the technical solutions in the embodiments of the present disclosure more clearly, the following briefly describes the accompanying drawings required to be used in the embodiments. Apparently, the accompanying drawings in the following description show merely some embodiments of the present disclosure, and a person of ordinary skill in the art may still derive other drawings from these accompanying drawings.

DETAILED DESCRIPTION

For better understanding of the technical solutions of the present disclosure, the embodiments of the present disclosure are described in detail below with reference to the accompanying drawings.

It should be noted that the embodiments in the following descriptions are only a part rather than all of the embodiments in the present disclosure. It is obvious for those skilled in the art that various modifications and changes may be made to the present disclosure without departing from the spirit or scope of the present disclosure. Therefore, the present disclosure is intended to cover the modifications and changes on the present disclosure that fall within the range of the corresponding claims (technical solutions claimed) and equivalents thereof. It should be noted that, the implementations provided in the embodiments of the present disclosure cart be combined with each other if no conflict occurs.

Terms in the embodiments of the present disclosure are merely used to describe the specific embodiments, and are not intended to limit the present disclosure. Unless otherwise specified in the context, words, such as "a", "the", and "this", in a singular form in the embodiments of the present disclosure and the appended claims include plural forms.

It should be understood that the term "and/or" in this specification merely describes associations between associated objects, and it indicates three types of relationships. For example, A and/or B may indicate that A exists alone, A and B coexist, or B exists alone. In addition, the character "/" in this specification generally indicates that the associated objects are in an "or" relationship.

As described in the background, in the idle mode, the display panel is driven with a low frequency. In the case of low-frequency driving, a driving cycle of a next frame takes a relatively long time, To avoid continuous light emitting of a light-emission element over a long time, in the related art, the display panel is generally refreshed at a high frequency by using a light-emission control signal line, and an enable frequency of a light-emission control signal is increased, to control the light-emission element to emit light intermittently. For example, the driving frequency of the display panel is 15 Hz, while the enable frequency of the light-emission control signal is 60 Hz.

Accordingly, a driving cycle of a pixel circuit may include a writing phase and a plurality of holding phases. In the writing phase, the pixel circuit may reset and charge a gate of a drive transistor and control the light-emission element to emit light; in the holding phases, the pixel circuit may no longer perform the resetting and charging operations, but drive, by still using a display voltage written in the writing phase, the light-emission element to emit light according to a driving current converted from the display voltage.

Specific description is provided below by using the pixel circuit shown in FIG. 1 as an example.

Figure 1:
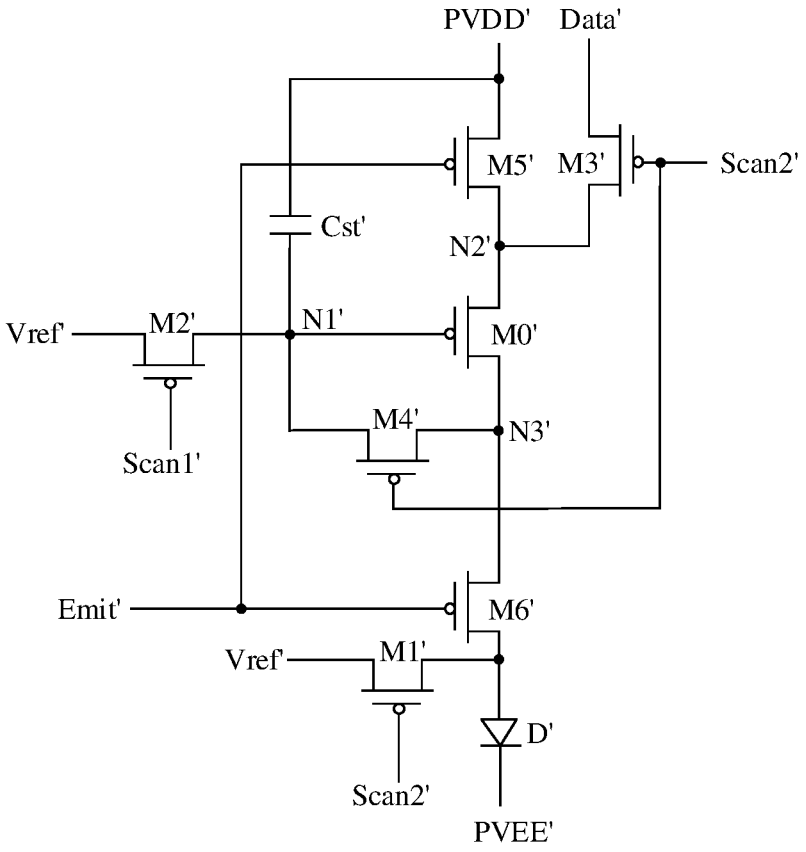
FIG. 1 is a schematic structural diagram of a pixel circuit in the related art.

FIG. 1 is a schematic structural diagram of a pixel circuit in the related art. As shown in FIG. 1, the pixel circuit may include a drive transistor M0', a first reset transistor M1', a second reset transistor M2', a data writing transistor M3', a threshold compensation transistor M4', a first light-emission control transistor M5', a second light-emission control transistor M6', and a storage capacitor Cst'.

Figure 2:
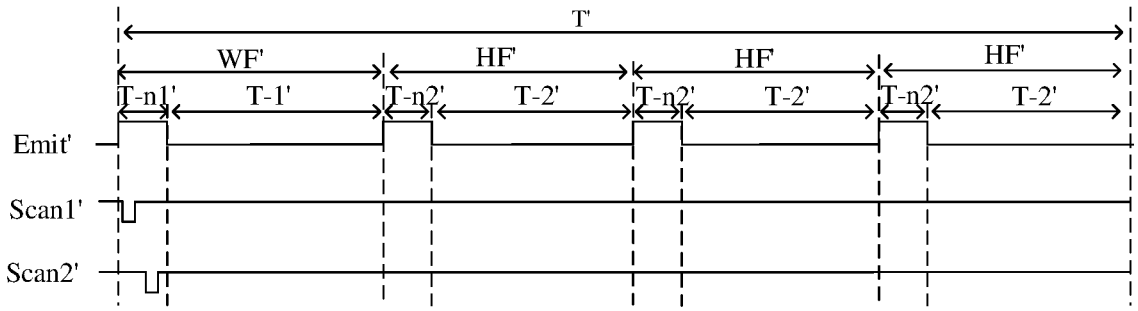
FIG. 2 is a sequence diagram corresponding to FIG. 1.

FIG. 2 is a sequence diagram corresponding to FIG. 1. As shown in FIG. 2, a driving cycle T' of the pixel circuit may include a writing phase WF' and a plurality of holding phases HF'. For example, when the driving frequency of the display panel is 15 Hz and the enable frequency of the light-emission control signal is 60 Hz, the driving cycle T' may include one writing phase WF' and three holding phases HF'. The writing phase WF' may include a first non-light-emission period T-n1' and a first light-emission period T-1'; the holding phase HF may include a second non-light-emission period T-n2' and a second light-emission period T-2'.

In the first non-light-emission period T-n1', first, the first scanning signal line Scan1' provides a low level, and the second reset transistor M2' resets a gate of the drive transistor M0' by using the reset voltage $V_{ref}'$; in this case, $V_{N1}'=V_{ref}'$. Then, the second scanning signal line Scan2' provides a low level, and the first reset transistor M1' resets an anode of the light-emission element D' by using the reset voltage $V_{ref}'$. At the same time, the data writing transistor M3' and the threshold compensation transistor M4' write a display voltage $V_{Data}'$ into the first node N1', and compensate a threshold voltage $V_{th}'$ of the drive transistor M0'; in this case, $V_{N1}'=V_{Data}'-V_{th}'$, and $V_{N2}'=V_{Data}'$.

In the first light-emission period T-1', the light-emission control signal line Emit' provides a low level; the first light-emission control transistor M5' and the second light-emission control transistor M6' control a path between the power signal line PVDD' and the light-emission element D' to be turned on, and transmit a driving current converted by the drive transistor M0' to the light-emission element D', to drive the light-emission element D' to emit light. In this case, $V_{N1}':=V_{Data}'-V_{th}'$, and $V_{N2}'=V_{PVDD}'$, where $V_{PVDD}'$ is a power voltage.

In the second non-light-emission period T-n2', the first scanning signal line Scan1' and the second scanning signal line Scan2' are set to a high potential; the first reset transistor M1', the second reset transistor M2', the data writing transistor M3', and the threshold compensation transistor M4' are turned off, and in this case, $V_{N2}'=V_{PVDD}'$.

In the second light-emission period T-2', the light-emission control signal line Emit' provides a low level, and the driving current converted by the drive transistor M0' flows into the light-emission element D', to drive the light-emission element D' to emit light.

It can be understood that, when the writing phase WF' and the holding phase HF' proceed to the light-emission periods, the driving current needs to charge the light-emission element D' to enable the light-emission element D' to emit light. Therefore, an early light-emission period of the light-emission element D' may include a brightness rising process, while a bias voltage state of the drive transistor M0' may affect a brightness rising speed. Based on the above, since the display voltage $V_{Data}'$ is not. written again in the holding phase HP, in the second non-light-emission period T-n2', the second node N2' maintains the power voltage $V_{PVDD}'$, which causes an excessively large difference between voltages of the second node N2' in the second non-light-emission period T-n2' and the first non-light-emission period T-n1', thus making the bias voltages of the drive transistor M0' significantly different in the two periods.

Thus, when the writing phase WF' and the holding phase HF' proceed to the light-emission periods, the light-emission element D' has different brightness rising speeds, resulting in picture flickering. Particularly, when the display panel displays a low-grayscale picture, the low grayscale corresponds to a relatively low driving current, and thus the light-emission element D' is charged at a low speed with the driving current. Therefore, the difference between brightness rising speeds caused by the difference between bias voltages of the drive transistor M0' is more significant, which undoubtedly aggravates the flickering. Moreover, the difference between driving currents further leads to different charging states of the light-emission element D' charged by the driving currents in the writing phase WF' and the holding phase HF', and further aggravates smearing during picture switching in the case of low-frequency driving.

To solve the above problems, the embodiments of the present disclosure provide a display panel. in the embodiments of the present disclosure, the second node is reset at a high frequency in the holding phase, which can effectively alleviate the problem of picture flickering under low frequency and low grayscale.

Figure 3:
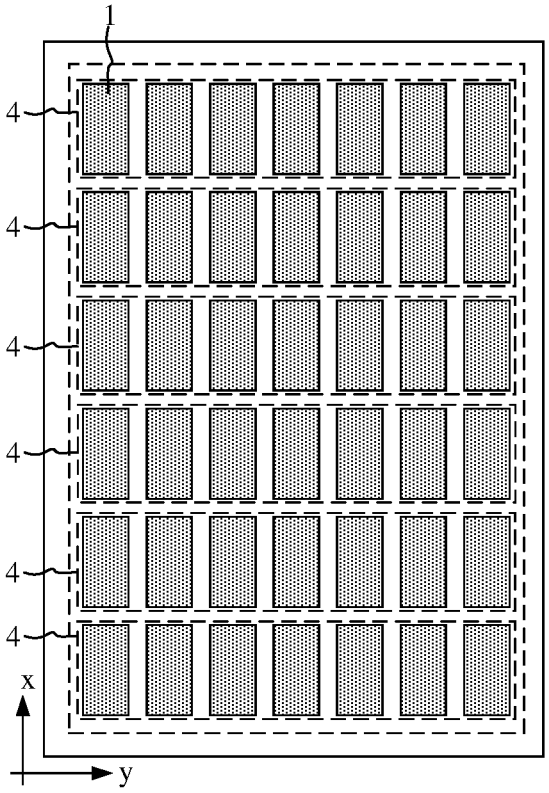
FIG. 3 is a schematic structural diagram of a display panel according to an embodiment of the present disclosure.

FIG. 3 is a schematic structural diagram of a display panel according to an embodiment of the present disclosure. As shown in FIG. 3, the display panel may include a plurality of pixel circuits 1. The plurality of pixel circuits 1 may be arranged in a matrix. It should be noted that, in the technical solution provided by the present disclosure, the pixel circuits are described by taking P-type transistors as an example. However, in other optional implementations, transistors in the pixel circuits may be N-type transistors, or sonic of the transistors are P-type transistors and some are N-type transistors, which is not limited in the present disclosure.

Figure 4:
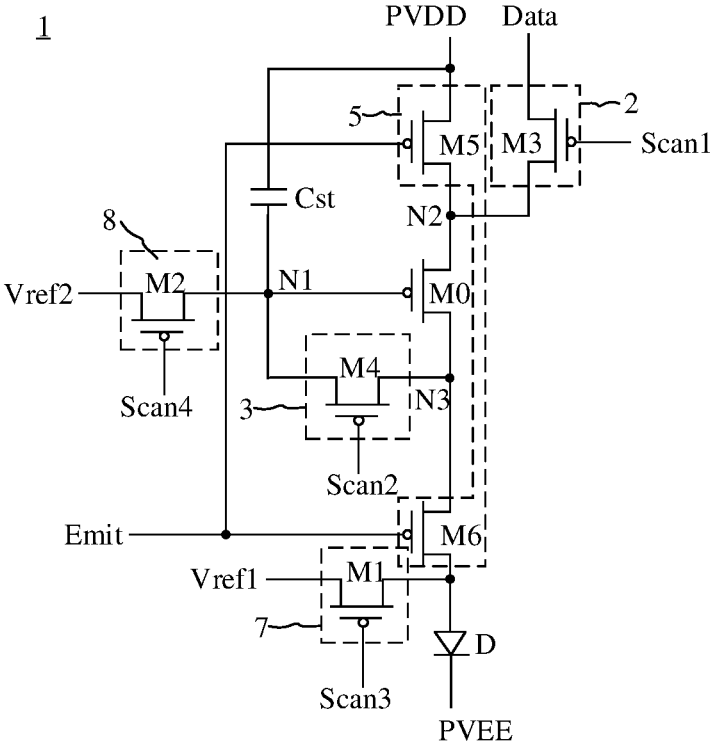
FIG. 4 is a schematic structural diagram of a pixel circuit according to an embodiment the present invention.

FIG. 4 is a schematic structural diagram of a pixel circuit according to an embodiment of the present disclosure. As shown in FIG. 4, the pixel circuit 1 includes a drive transistor M0, a voltage writing module 2, and a threshold compensation. module 3, A gate of the drive transistor MO is electrically connected to a first node N1, a first electrode of the drive transistor M0 is electrically connected to a second node N2, and a second electrode of the drive transistor M0 is electrically connected to a third node N3. The voltage writing module 2 is electrically connected to a first scanning signal line Scant, a data line Data, and the second node N2. The threshold compensation module 3 is electrically connected to a second scanning signal line Scan2, the third node N3, and the first node N1.

Figure 5:
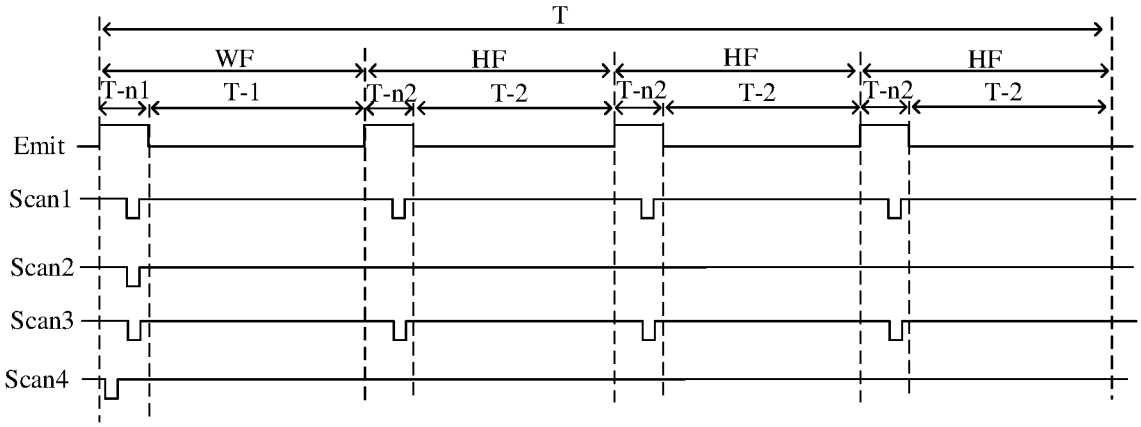
FIG. 5 is a sequence diagram corresponding to FIG. 4.

FIG. 5 is a sequence diagram corresponding to FIG. 4. As shown in FIG. 5, a driving cycle T of the pixel circuit 1 includes a writing phase WF and at least one holding phase HF, wherein the writing phase WF includes a first non-light-emission period T-n1, and the holding phase HF includes a second non-light-emission period T-n2. The voltage writing module 2 is configured to write a display voltage $V_{Data}$ into the second node N2 in the first non-light-emission period T-n1 in response to an enable level of the first scanning signal, and write a node reset voltage $V_1$ into the second node N2 in at least a part of the second non-light-emission period T-n2 in response to the enable level of the first scanning signal. The threshold compensation module 3 is configured to compensate a threshold voltage of the drive transistor M0 in the first non-light-emission period T-n1 in response to an enable level of a second scanning signal.

In other words, in the embodiments of the present disclosure, an enable frequency of the first scanning signal is higher than a driving frequency of the display panel (an enable frequency of the second scanning signal). For example, the driving frequency of the display panel is 15 Hz, and the enable frequency of the first scanning signal is 30 Hz, 60 Hz, 90 Hz, 120 Hz, or the like.

Specifically, in the first non-light-emission period T-n1, the first scanning signal and the second scanning signal have the enable levels respectively. The voltage writing module 2 and the threshold compensation module 3 work in coordination to write the display voltage $V_{Data}$ after the compensation into the first node N1; in this period, $V_{N1}=V_{Data}-V_{th}$, and $V_{N2}=V_{Data}$. In the second non-light-emission period T-n2, the first scanning signal has the enable level, and the second scanning signal has a non-enable level. The voltage writing module 2 works alone to write the node reset voltage $V_1$ into the second node N2; in this case, $V_{N1}=V_{Data}-V_{th}$, and $V_{N2}=V_1$. It may be understood that, with reference to the above analysis on the related art, in the embodiments of the present disclosure, the node reset voltage $V_1$ is closer to the display voltage $V_{Data}$ compared with the power voltage $V_{PVDD}$. That is, an absolute value of the difference between the display voltage $V_{Data}$ and the node reset voltage $V_1$ is less than an absolute value of the difference between the display voltage $V_{Data}$ and the power voltage $V_{PVDD}$.

In the embodiments of the present disclosure, the second node N2 is reset at a high frequency by using the voltage writing module 2, such that a node reset voltage $V_1$ which is closer to the display voltage $V_{Data}$ can be written into the second node N2 in at least a part of the second non-light-emission period T-n2 in the holding phase HF, thereby reducing a difference between voltages of the second node N2 in the second non-light-emission period T-n2 and the first non-light-emission period T-n1, and making bias voltages of the drive transistor M0 in the two periods to be consistent. This not only alleviates the problem of smearing during picture switching in the case of low-frequency driving, but also reduces a difference between brightness rising speeds during early light-emission periods in the writing phase WF and the holding phase HF, thereby effectively alleviating the picture flickering in the case of low-frequency low-grayscale, display.

Figure 6:
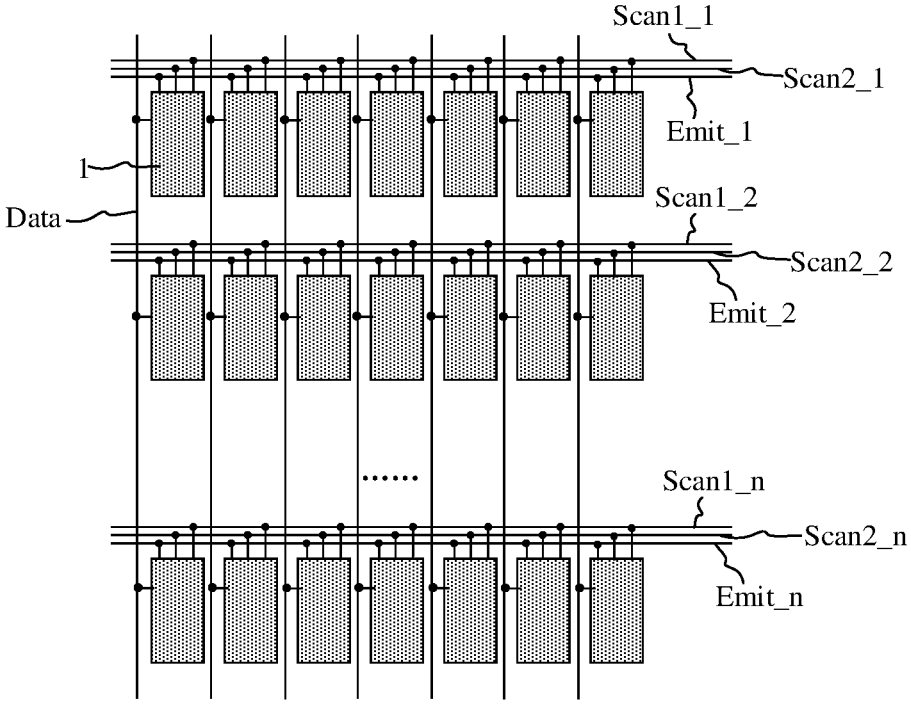
FIG. 6 is a schematic diagram of connection between signal lines and pixel circuits according to an embodiment of the present disclosure.
Figure 7:
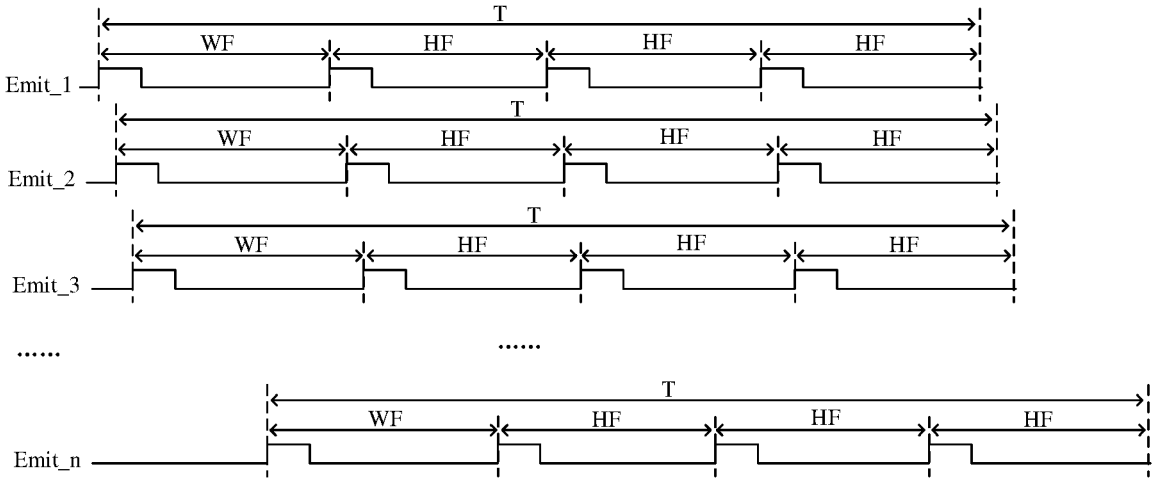
FIG. 7 is a sequence diagram of light-emission control signals according to an embodiment of the present disclosure.

It should be noted that, in the embodiments of the present disclosure, although the data line Data is used for transmitting the node reset voltage $V_1$, this does not affect normal writing of the display voltage $V_{Data}$. FIG. 6 is a schematic diagram of connection between signal lines and pixel circuits according to an embodiment of the present disclosure. As shown in FIG. 6, pixel circuits 1 in the same column can be electrically connected to the same data line Data, and the voltage transmitted on the data line Data can be written into the pixel circuits 1 in the first row to the n-th row in a time division manner. The driving cycle T described in the embodiments of the present disclosure may refer to a driving cycle T of a single pixel circuit 1. It is assumed that the display panel includes n rows of pixel circuits 1. FIG. 7 is a sequence diagram of light-emission control signals according to an embodiment of the present disclosure. As shown in FIG. 7, n light-emission control signal lines Emit sequentially output non-enable levels (high levels) to the n rows of pixel circuits 1, such that the n rows of pixel circuits 1 sequentially enter the first non-light-emission period T-n1 of the writing phase WF. The pixel circuits 1 in the first row do not enter the first holding phase HF of the driving cycle T until the first non-light-emission period T-n1 of the pixel circuits 1 in the last row is ended. In other words, before the data lines Data start to transmit the node reset voltage $V_1$ to the pixel circuits 1 in the first row, the data lines Data have finished transmitting the display voltage $V_{Data}$ to all the pixel circuits 1 in the n rows, thus avoiding the case that the data lines Data need to transmit the node reset voltage V1 to one row of pixel circuits 1 and transmit the display voltage $V_{Data}$ to another row of pixel circuits 1 at the same time. Therefore, in the embodiments of the present disclosure, transmission of the node reset voltage by using the data line Data does not affect normal charging of the pixel circuits 1.

In an optional implementation, the node reset voltage $V_1$ is a fixed voltage. For example, the node reset voltage $V_1$ may be a constant voltage $V_{GMP}$. Generally, the constant voltage $V_{GMP}$ of the display panel is approximately 5V, which is close to the value of the display voltage corresponding to low grayscale. Alternatively, the node reset voltage $V_1$ may be a voltage corresponding to a specific grayscale value, e.g., a voltage corresponding to a grayscale value of 128. In this case, when the display voltage corresponding to any grayscale value is written into the second node N2 in the writing phase WF, the difference between the node reset voltage $V_1$ and the written display voltage can be made smaller.

In an optional implementation, as shown in FIG. 3, the display panel includes a plurality of circuit rows 4 arranged along a first direction x, each of the circuit rows 4 includes a plurality of pixel circuits 1 arranged along a second direction y, and the first direction x intersects the second direction y.

Figure 8:
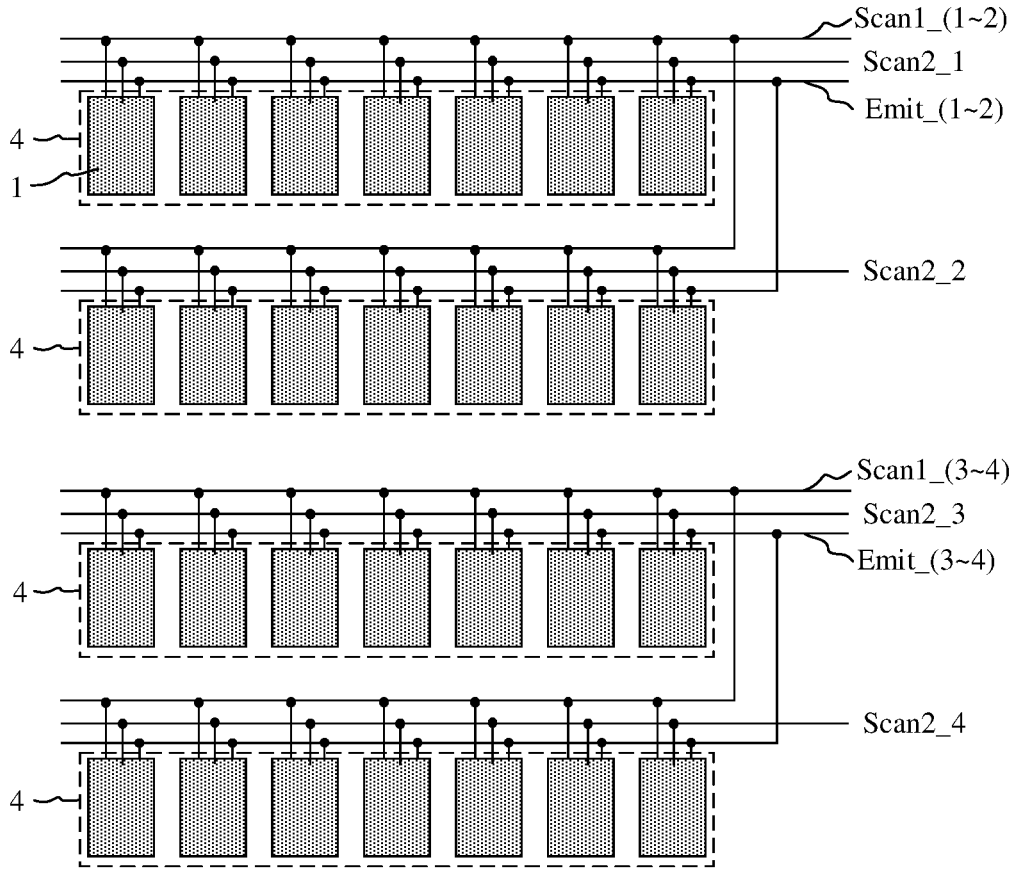
FIG. 8 is another schematic diagram of connection between signal lines and pixel circuits according to an embodiment of the present disclosure.

With reference to FIG. 3 and FIG. 4, FIG. 8 is another schematic diagram of connection between signal lines and pixel circuits according to an embodiment of the present disclosure. As shown in FIG. 8, one first scanning signal line Scan1 is electrically connected to the voltage writing modules 2 of the pixel circuits 1 in x circuit rows 4, x being a positive integer greater than or equal to 1. In addition, one second scanning signal line Scan2 is electrically connected to the threshold compensation modules 3 of the pixel circuits 1 in one circuit row.

It should be noted that, to simplify the diagrams for schematically showing connection between the signal lines and the pixel circuits in the embodiments of the present disclosure (such as FIG. 6, FIG. 8, FIG. 10, and FIG. 12), these figures do not specifically show which modules in the pixel circuits 1 are electrically connected to the signal lines. However, it can be understood that, when a signal line is electrically connected to a certain pixel circuit 1, specifically, the signal line is electrically connected to a particular module in the pixel circuit 1. For example, with reference to FIG. 4, FIG. 8 schematically shows that one first scanning signal line Scan2 is electrically connected to pixel circuits 1 in two circuit rows 4, and actually, the first scanning signal line Scant is electrically connected to the voltage writing modules 2 of the pixel circuits 1 in the two circuit rows 4. FIG. 8 schematically shows that one second scanning signal line Scan2 is electrically connected to pixel circuits 1 in two circuit rows 4, and actually, the second scanning signal line Scan2 is electrically connected to the threshold compensation modules 3 of the pixel circuits 1 in the two circuit rows 4. Moreover, for ease of understanding, in these figures, the first scanning signal line Scan1 electrically connected to the i-th to (i+x)-th circuit rows 4 is denoted by Scan1_(i~i+x), and the second scanning signal line Scan2 electrically connected to the i-th circuit row 4 is denoted by Scan2_*i*.

In the foregoing driving manner, when x≥2, for the x circuit rows 4 electrically connected to one first scanning signal line Scan1, the enable level of the first scanning signal provided by the first scanning signal line Scan1 overlaps with enable levels of x second scanning signals corresponding to the x circuit rows 4, such that the pixel circuits 1 in each circuit row 4 can charge the first node N1 in the first non-light-emission period T-n1 of the respective driving cycle T.

Figure 9:
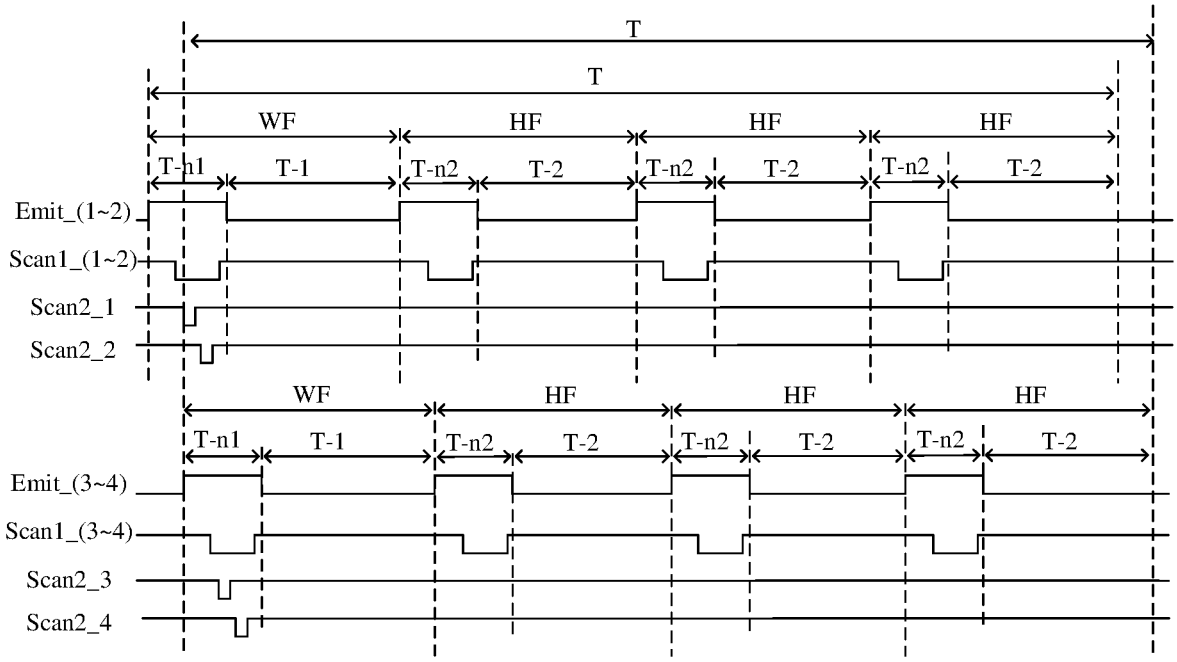
FIG. 9 is a sequence diagram corresponding to FIG. 8.

Taking x=2 as an example, FIG. 9 is a sequence diagram corresponding to FIG. 8. As shown in FIG. 9, the low level of the first scanning signal Scan1_(1~2) electrically connected to the first and second circuit rows 4 covers the low level of the second scanning signal Scan2_1 corresponding to the circuit row 4 and the low level of the second scanning signal Scan2_2 corresponding to the second circuit row 4; the low level of the first scanning signal Scan1_(3~4) electrically connected to the third and fourth circuit rows 4 covers the low level of the second scanning signal Scan2_3 corresponding to the third circuit row 4 and the low level of the second scanning signal Scan2_4 corresponding to the fourth circuit row 4; the rest can be deduced by analogy.

When one first scanning signal line Scan1 is electrically connected to at least two circuit rows 4, the number of stages of scan shift registers for outputting signals to the first scanning signal lines Scan1 can be reduced, thereby reducing the space occupied by the scan shift registers within the bezel area, which is conducive to the narrow bezel design of the display panel.

Further, referring to FIG. 4, the pixel circuit 1 further includes a light-emission control module 5, wherein the light-emission control module 5 is electrically connected to the light-emission control signal line Emit, the power signal line PVDD, the second node N2, the third node N3, and the anode of the light-emission element D. Referring to FIG. 5, the writing phase WF further includes a first light-emission period T-1, and the holding phase HF further includes a second light-emission period T-2. The light-emission control module 5 is configured to transmit a driving current to the anode of the light-emission element D in the first light-emission period T-1 and the second light-emission period T-2 in response to an enable level of a light-emission control signal.

Referring to FIG. 8, one light-emission control signal line Emit is electrically connected to the light-emission control modules 5 of the pixel circuits 1 in y circuit rows 4, y being a positive integer greater than or equal to 1. For ease of understanding, in FIG. 8, the light-emission control signal line Emit electrically connected to the i-th to (i+y)-th circuit rows 4 is denoted by Emit_(~i+y).

When one light-emission control signal line Emit is electrically connected to at least two circuit rows 4, the number of stages of light-emission shift registers for outputting signals to the light-emission control signal lines Emit can be reduced, thereby reducing the space occupied by the light-emission shift registers within the bezel area, which is conducive to the narrow bezel design of the display panel.

In an optional implementation, referring to FIG. 8 and FIG. 9 again, x=y, and x≥2. That is, one light-emission control signal line Emit and one first scanning signal line Scan1 are electrically connected to the same x circuit rows 4. In this case, it is only necessary to make the non-enable levels of the light-emission control signals corresponding to the x circuit rows 4 cover the enable level of the first scanning signal. The control method for signal output is easier, while the number of stages of the light-emission shift registers and scan shift registers is also reduced, thereby further reducing the bezel width of the display panel.

Figure 10:
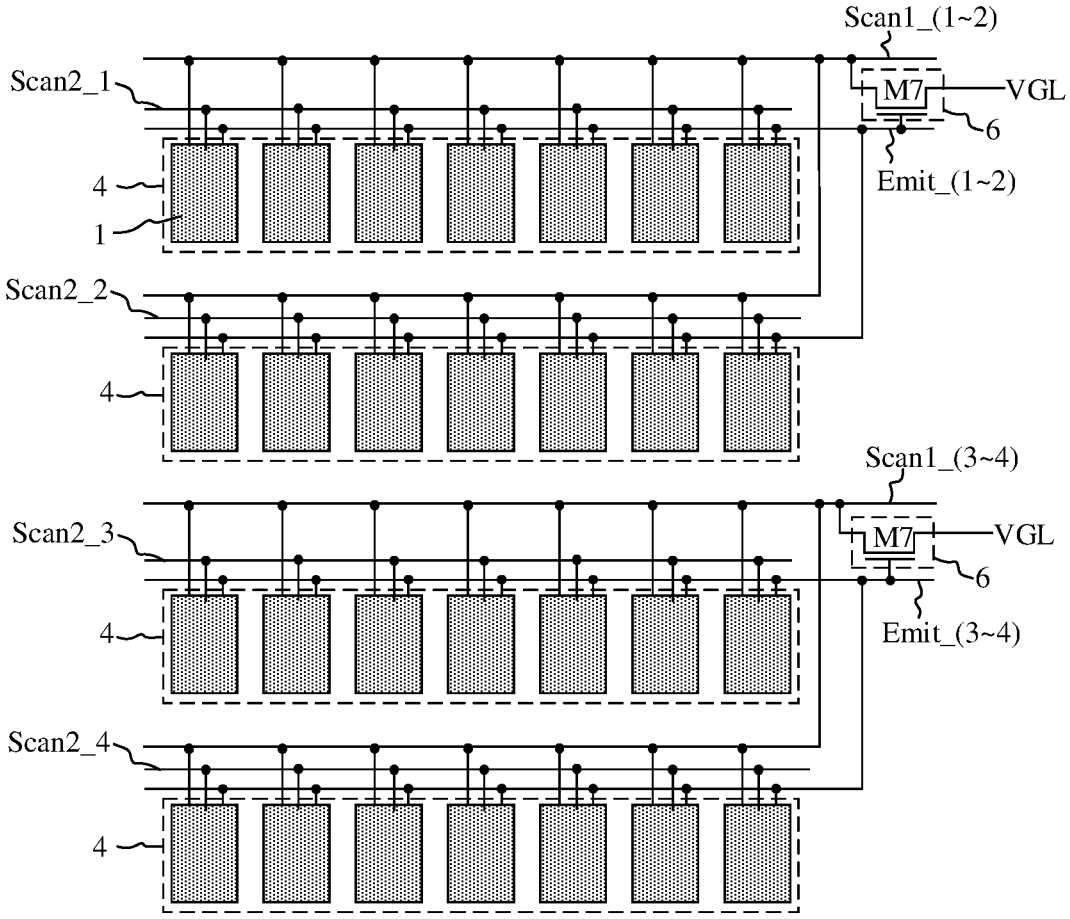
FIG. 10 is still another schematic diagram of connection between signal lines and pixel circuits according to an embodiment of the present disclosure.
Figure 11:
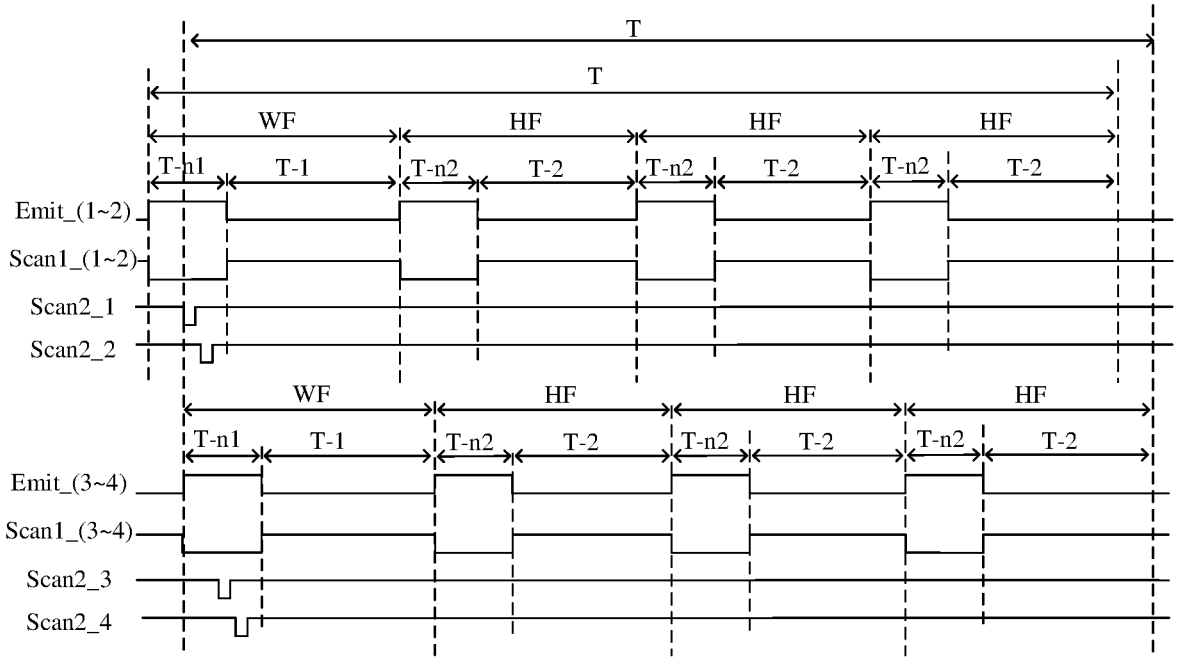
FIG. 11 is a sequence diagram corresponding to FIG. 10.

In an optional implementation, as shown in FIG. 10 and FIG. 11, FIG. 10 is still another schematic diagram of connection between signal lines and pixel circuits according to an embodiment of the present disclosure, and FIG. 11 is a sequence diagram corresponding to FIG. 10, wherein x=y. The display panel further includes control modules 6, wherein control terminals of the control modules 6 are electrically connected to the light-emission control signal lines Emit, input terminals of the control modules 6 are electrically connected to first fixed potential signal lines VGL, the first fixed potential signal lines VGL are used for providing the enable levels of the first scanning signals, and output terminals of the control modules 6 are electrically connected to the first scanning signal lines Scan1. The first scanning signal line Scan1 and the light-emission control signal line Emit electrically connected to the same control module 6 are electrically connected to the same x circuit rows 4.

Specifically, when the light-emission control signal line Emit outputs a non-enable level, the control module 6 transmits, in response to the non-enable level, an enable level outputted by the first fixed potential signal line VGL to the first scanning signal line Scan1, such that the first scanning signal line Scan1 outputs an enable level to the pixel circuits 1 connected thereto. It should be noted that, as compared with the sequence of the first scanning signals shown in FIG. 9, the pulse width of the enable level of the first scanning signal in such a configuration increases the pulse width to be the same as the pulse width of the non-enable level of the light-emission control By using this configuration, the output of the first scanning signal only needs to be controlled by the light-emission control signal, and it is unnecessary to set a separate scan shift register corresponding to the first scanning signal line Scan1, which further simplifies the structure of the display panel and reduces the bezel width. Moreover, in such a configuration, the enable frequency of the first scanning signal is the same as that of the light-emission control signal, and the second node N2 can be reset in each holding phase HF. The node is reset at a higher frequency, thereby achieving a better improvement effect for the bias voltage of the drive transistor M0.

Further, referring to FIG. 10, each of the control modules 6 includes a control transistor M7, wherein a gate of the control transistor M7 is electrically connected to the light-emission control signal line Emit, a first electrode of the control transistor M7 is electrically connected to the first fixed potential signal line VGL, and a second electrode of the control transistor M7 is electrically connected to the first scanning signal line Scan1. When the light-emission control signal line Emit outputs a non-enable level, the control transistor M7 is turned on under the effect of the non-enable level to transmit the enable level provided by the first fixed potential signal line VGL to the first scanning signal line Scan1. It should be noted that, in the technical solution provided by the present disclosure, M7 being an N-type transistor is taken as an example for description. in other optional implementations, M7 may alternatively be a P-type transistor, which is not limited in the embodiments of the present disclosure.

Figure 12:
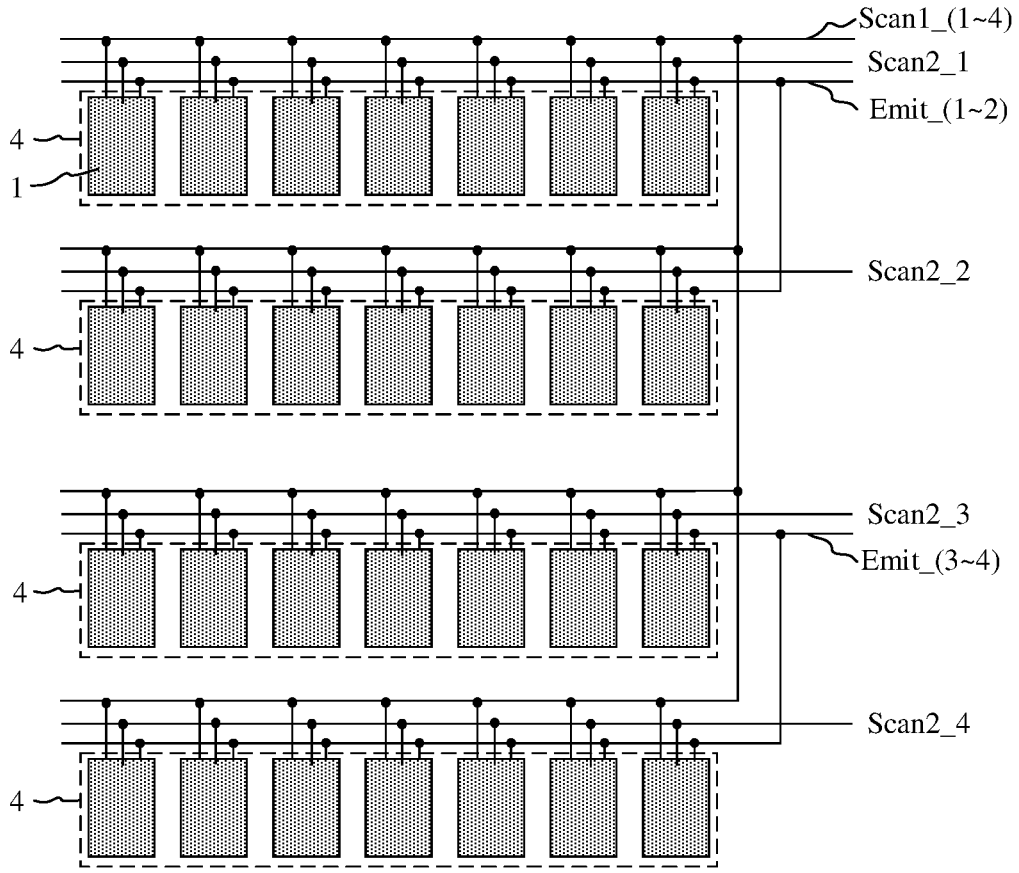
FIG. 12 is yet another schematic diagram of connection between signal lines and pixel circuits according to an embodiment of the present disclosure.
Figure 13:
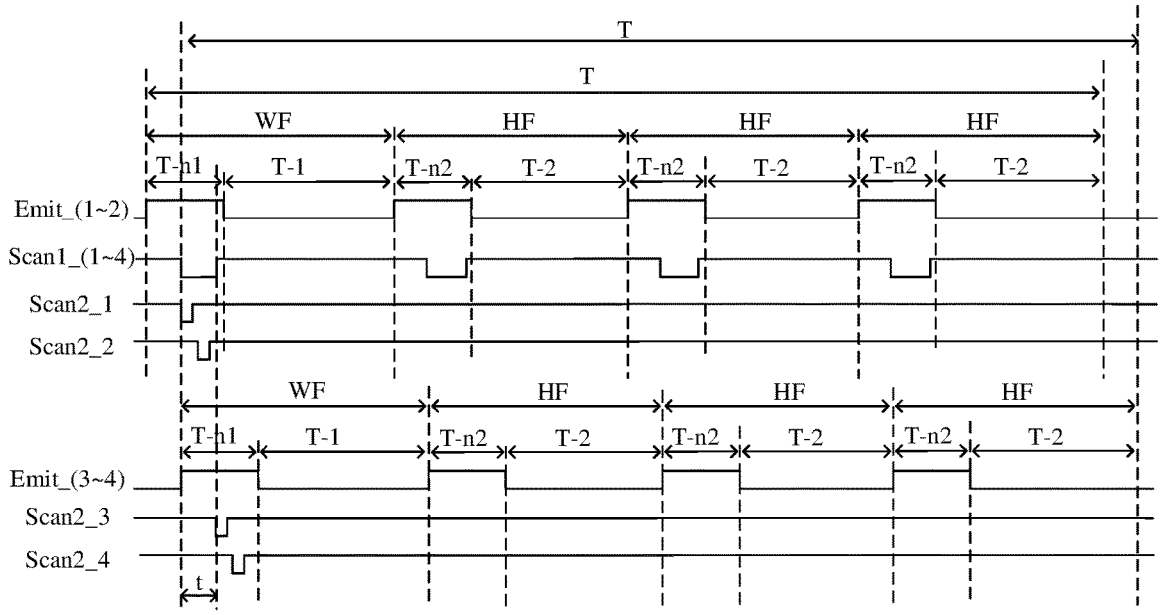
FIG. 13 is a sequence diagram corresponding to FIG. 12.

In an optional implementation, as shown in FIG. 12 and FIG. 13, FIG. 12 is yet another schematic diagram of connection between signal lines and pixel circuits according to an embodiment of the present disclosure, and FIG. 13 is a sequence diagram corresponding to FIG. 12, wherein x>y. For example, referring to FIGS. 12, x=4, and y=2. Moreover, for the x circuit rows 4 electrically connected to the same first scanning signal line Scan1, there is an overlapping range t between non-enable levels of at least two light-emission control signals corresponding to the x circuit rows 4, and the enable level of the first scanning signal is within the overlapping range t.

The foregoing structure can reduce the number of stages of scan shift registers (or scan shift registers and light-emission shift registers) and reduce the space occupied by the shift registers in the bezel area. Moreover, the enable level of the first scanning signal falls within the overlapping range t between the non-enable levels of at least two light-emission control signals, to prevent the low level of the first scanning signal corresponding to a certain pixel circuit 1 from overlapping with the low level of the light-emission control signal corresponding to another pixel circuit 1 in the same column, thereby preventing another pixel circuit 1, when controlling the light-emission element D to emit light, from writing the node reset voltage into the second node N2, thus avoiding affecting normal light emitting of the light-emission element D driven by another pixel circuit 1.

In related art, referring to FIG. 1, the pixel circuit resets the anode of the light-emission element D' only in the writing phase WF', which also causes flickering of a picture displayed by the display panel.

With reference to FIG. 1 and FIG. 2, in the writing phase WF' and each holding phase HF', the light-emission control signal Emit' has a voltage jump; the light-emission control signal Emit' is set to a high potential in the first non-light-emission period T-n1' and the second non-light-emission period T-n2', and is set to a low potential in the first light-emission period T-1' and the second light-emission period T-2'.

Figure 14:
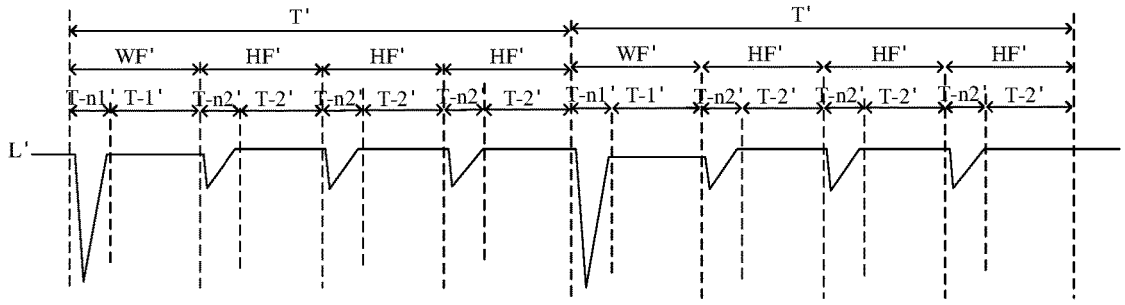
FIG. 14 is a schematic diagram showing changes in picture brightness in the related art.

In the first non-light-emission period T-n1' of the writing phase WF', the second scanning signal Scan2' is set to a low potential, the first reset transistor M1' transmits the reset voltage Vref' to the anode of the light-emission element D' to force the potential of the anode down, such that a voltage difference between two ends of the light-emission element D' is less than a turn-on voltage thereof, to quickly switch the light-emission element D' to a non-light-emission state. in this case, the light-emission element D' is in a complete non-light-emission state, and does not emit light at all, With reference to the schematic diagram of changes in picture brightness in the related art shown in FIG. 14, the brightness L' of the picture displayed by the display panel significantly decreases in the first non-light.-emission period T-n1'.

In the second non-light-emission period T-n2' of the holding phase HF', because the second scanning signal Scan2' is continuously at a high potential, the holding phase HF' no longer uses the reset voltage $V_{ref}$' to reset the anode of the light-emission element D', and only uses the light-emission control signal Emit' to cut off the current path between the third node N3' and the light-emission element D', thereby controlling the light-emission element D' not to emit However, even if the current path between the third node N3' and the light-emission element D' is cut off, off-state leakage currents from other paths, such as the first reset transistor M1', still flow into the light-emission element D', resulting in incomplete turn-off of the light-emission element D', and the light-emission element D' still emits light. In this case, referring to FIG. 14, the brightness L' of the picture displayed by the display panel decreases by a smaller degree in the second non-light-emission period T-n2'.

Based on the analysis above, the frequency at the valley of the brightness L' of the picture displayed by the display panel is the same as the driving frequency of the display panel, which are both relatively low. Therefore, such brightness fluctuations easily cause obvious flickering easily perceived by the human eyes.

Particularly, when the display panel displays a low-grayscale picture, the low driving current charges the light-emission element D' at a relatively low speed. Therefore, during transition from the first non-light-emission period T-n1' to the first light-emission period T-1' in the writing phase WF', the screen brightness: also rises at a relatively low speed, which increases the risk of the brightness fluctuation being recognized by human eyes.

Accordingly, in an optional implementation, referring to FIG. 4 and FIG. 5 again, the pixel circuit 1 further includes a first reset module 7, wherein the first reset module 7 is electrically connected between the first reset signal line Vref1 and the anode of the light-emission element D; the first reset module 7 is configured to write the first reset voltage into the anode of the light-emission element 1) in the first non-light-emission period T-n1 and at least a part of the second non-light-emission period T-n2 in response to an enable level of a third scanning signal. In other words, in the embodiments of the present disclosure, an enable frequency of the third scanning signal is higher than the driving frequency of the display panel.

Figure 15:
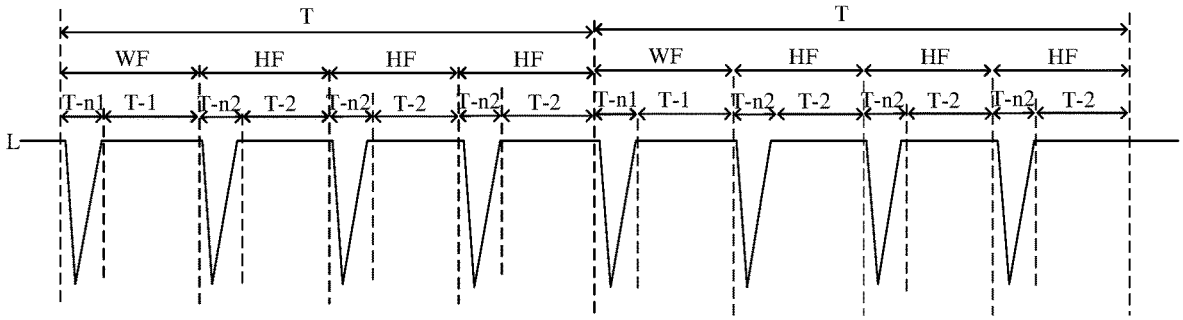
FIG. 15 is a schematic diagram showing changes in picture brightness according to an embodiment of the present disclosure.
Figure 16:
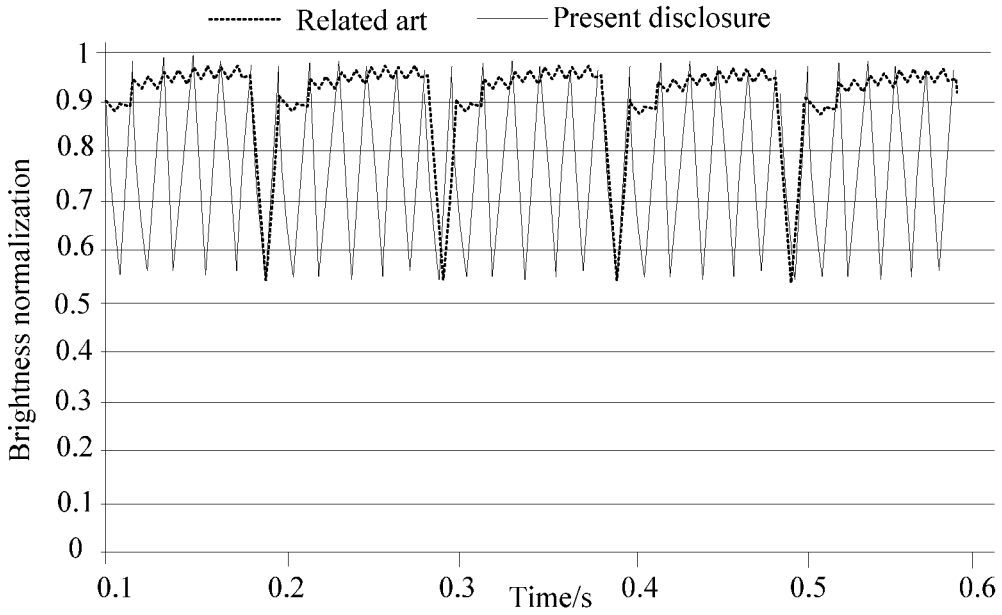
FIG. 16 is a schematic diagram of comparison between brightness changes in the related art and in an embodiment of the present disclosure.

With reference to the schematic diagram of changes in picture brightness according to an embodiment of the present disclosure shown in FIG. 15, and the schematic diagram of comparison between brightness changes in the related art. and in an embodiment of the present disclosure shown in FIG. 16, in the embodiments of the present disclosure, the anode of the light-emission element D is reset at a high frequency in the holding phase HF, to force the potential of the anode of the light-emission element D down, such that the brightness L of the picture displayed by the display panel also has a valley in the second non-light-emission period T-n2 of the holding phase HF; the brightness valley has a high occurrence frequency, making the brightness changes at such a frequency unperceivable to human eyes.

Figure 17:
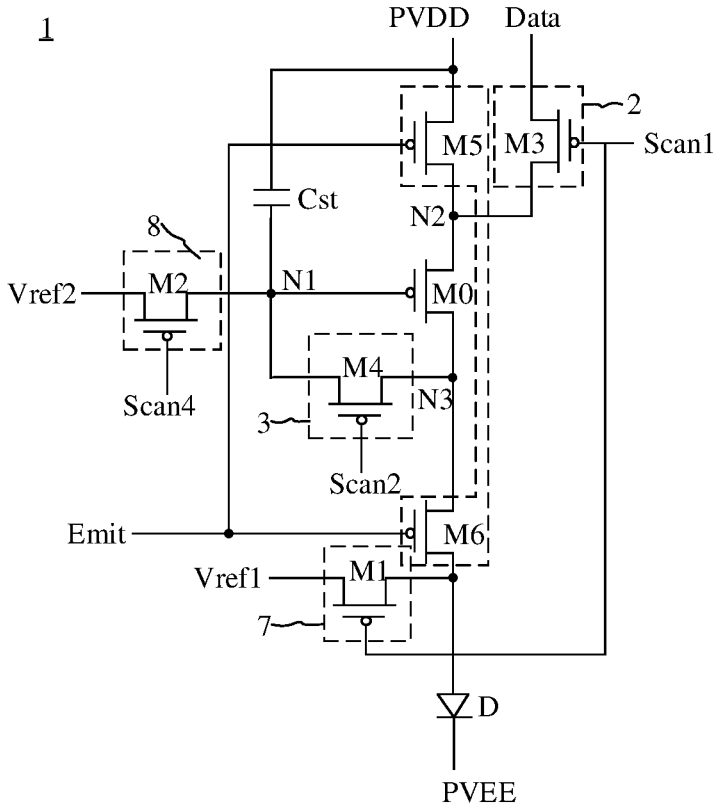
FIG. 17 is another schematic structural diagram of a pixel circuit according to an embodiment of the present disclosure.

In an optional implementation, FIG. 17 is another schematic structural diagram of a pixel circuit according to an embodiment of the present disclosure. As shown in FIG. 17, the first scanning signal line Scan1 is further used for providing a third scanning signal. The first reset module 7 is electrically connected to the first scanning signal line Scan1. In this case, both the third scanning signal and the first scanning signal are provided by the first scanning signal line Scan1; an enable frequency of the third scanning signal is the same as the enable frequency of the first scanning signal. It is unnecessary to arrange an additional scanning signal line for providing the third scanning signal, thereby reducing the wiring complexity.

Alternatively, in another optional implementation, referring to FIG. 4 and FIG. 5 again, the first reset module 7 is electrically connected to the third scanning signal line Scan3 for providing the third scanning signal. In this case, the first reset module 7 and the voltage writing module 2 are electrically connected to different scanning signal lines. The frequency of resetting the anode of the light-emission element D may be the same as or different from the frequency of resetting the second node N2, and the control method is more flexible.

Figure 18:
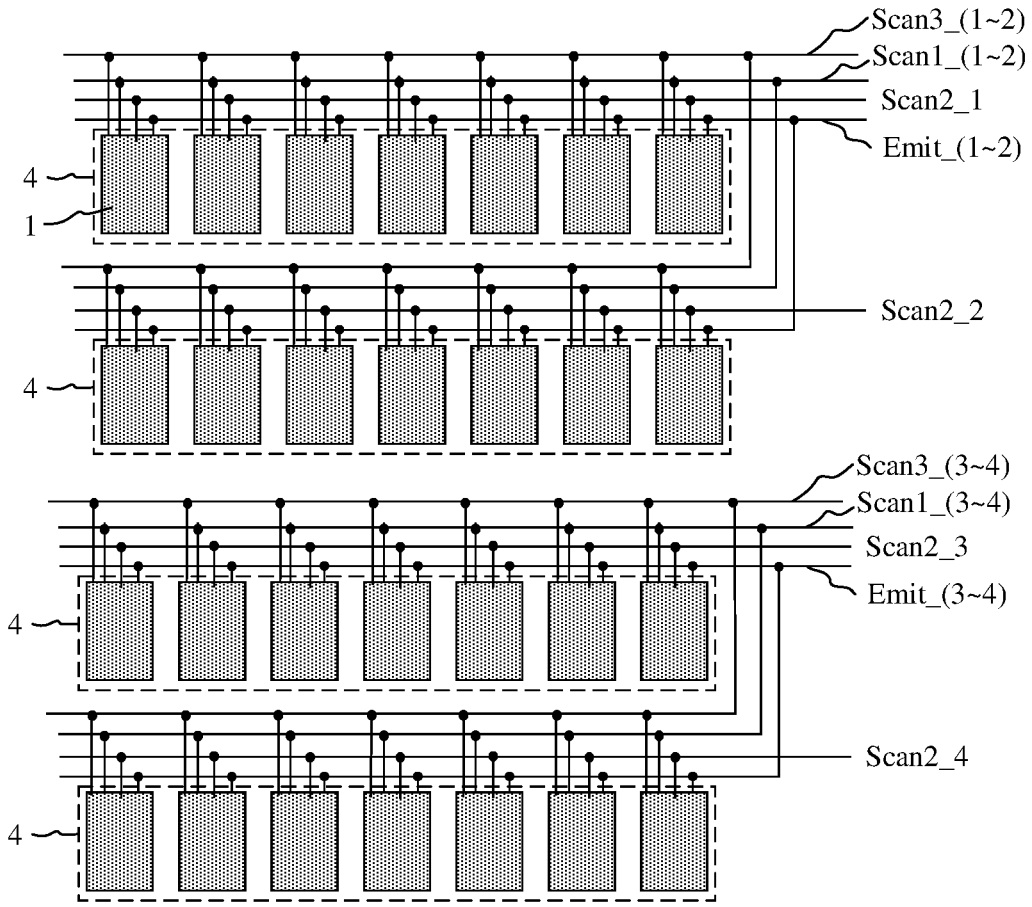
FIG. 18 is yet another schematic diagram of connection between signal lines and pixel circuits according to an embodiment of the present disclosure.
Figure 19:
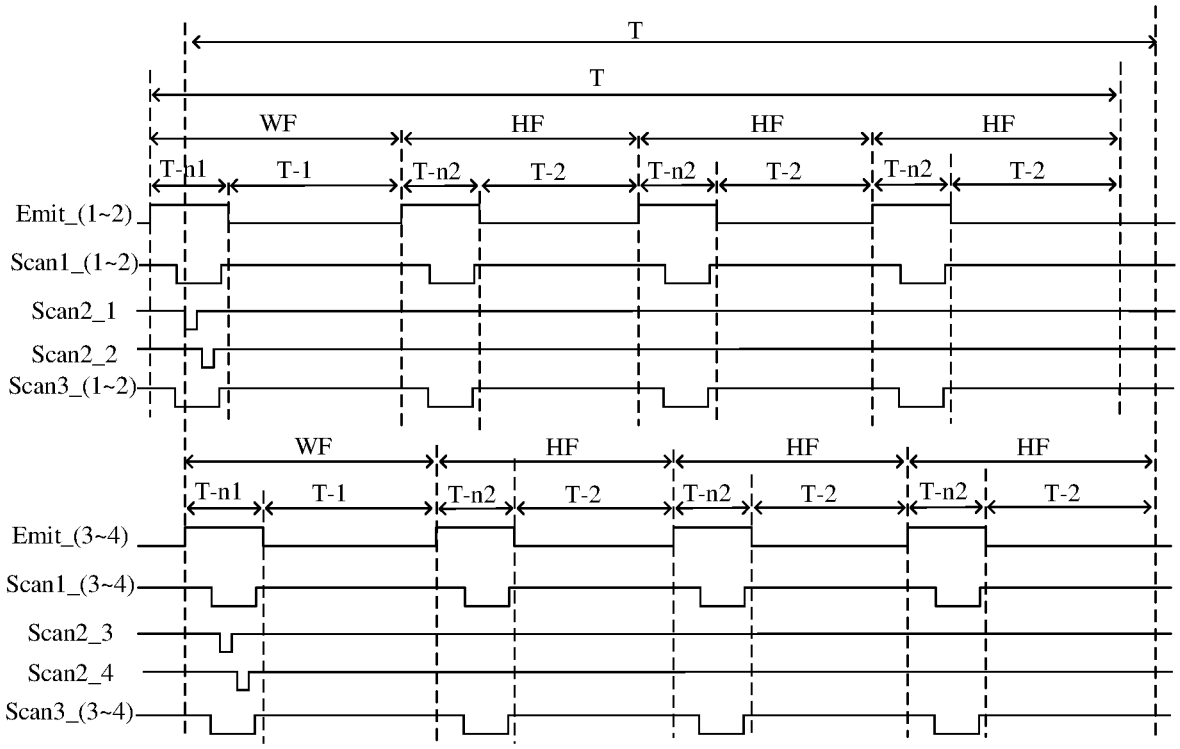
FIG. 19 is a sequence diagram corresponding to FIG. 18.

Further, when the first reset module 7 is electrically connected to the third scanning signal line Scan3 for providing the third scanning signal, with reference to FIG. 3, FIG. 18 is yet another schematic diagram of connection between signal lines and pixel circuits according to an embodiment of the present disclosure, and FIG. 19 is a sequence diagram corresponding to FIG. 18. As shown in FIG. 18 and FIG. 19, the display panel includes a plurality of circuit rows 4 arranged along a first direction x, each of the circuit rows 4 includes a plurality of pixel circuits 1 arranged along a second direction y, and the first direction x intersects the second direction y. One third scanning signal line Scan3 is electrically connected to the first reset modules 7 of the pixel circuits 1 in k circuit rows 4, wherein k is a positive integer greater than or equal to 1, thereby reducing the number of stages of scan shift registers for outputting signals to the third scanning signal lines Scan3 and reducing the space occupied by the scan shift registers in the bezel area.

Further, with reference to FIG. 4 and FIG. 5, the pixel circuit 1 further includes a light-emission control module 5. The light-emission control module 5 is electrically connected to the light-emission control signal line Emit, the power signal line PVDD, the second node N2, the third node N3, and the anode of the light-emission element D. The writing phase WF further includes a first light-emission period T-1, and the holding phase HF further includes a second light-emission period T-2. The light-emission control module 5 is configured to transmit a driving current to the anode of the light-emission element D in the first light-emission period T-1 and the second light-emission period T-2 in response to the enable level of the light-emission control signal.

Figure 20:
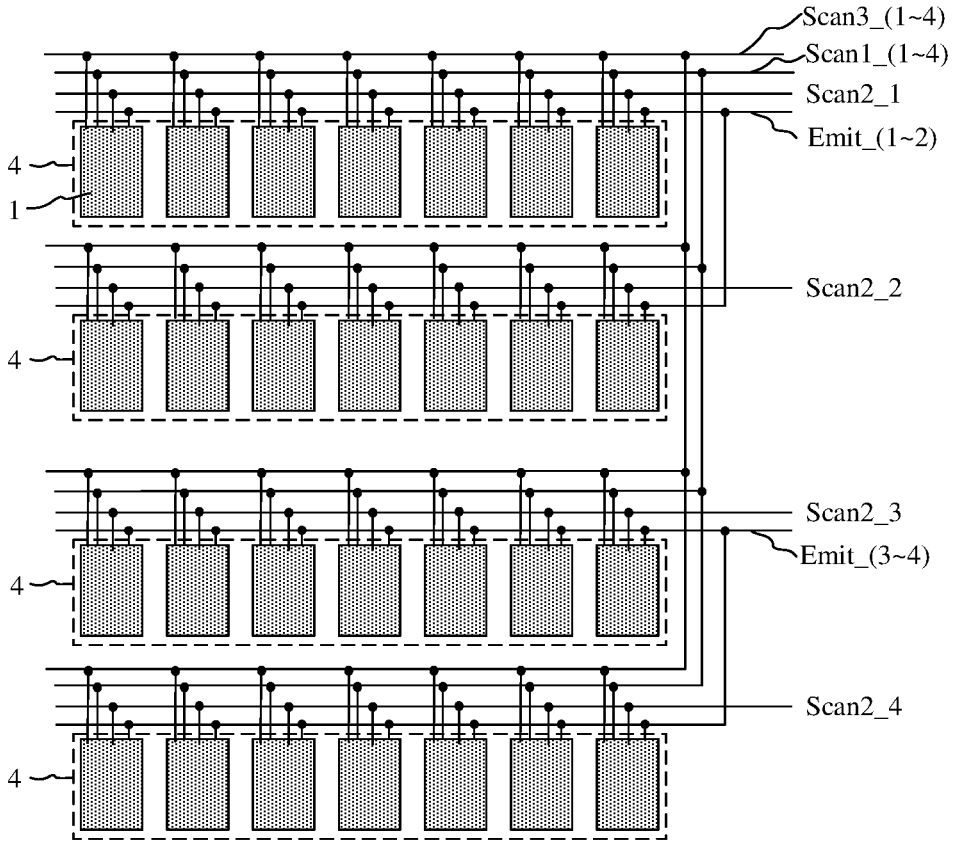
FIG. 20 is yet another schematic diagram of connection between signal lines and pixel circuits according to an embodiment of the present disclosure.
Figure 21:
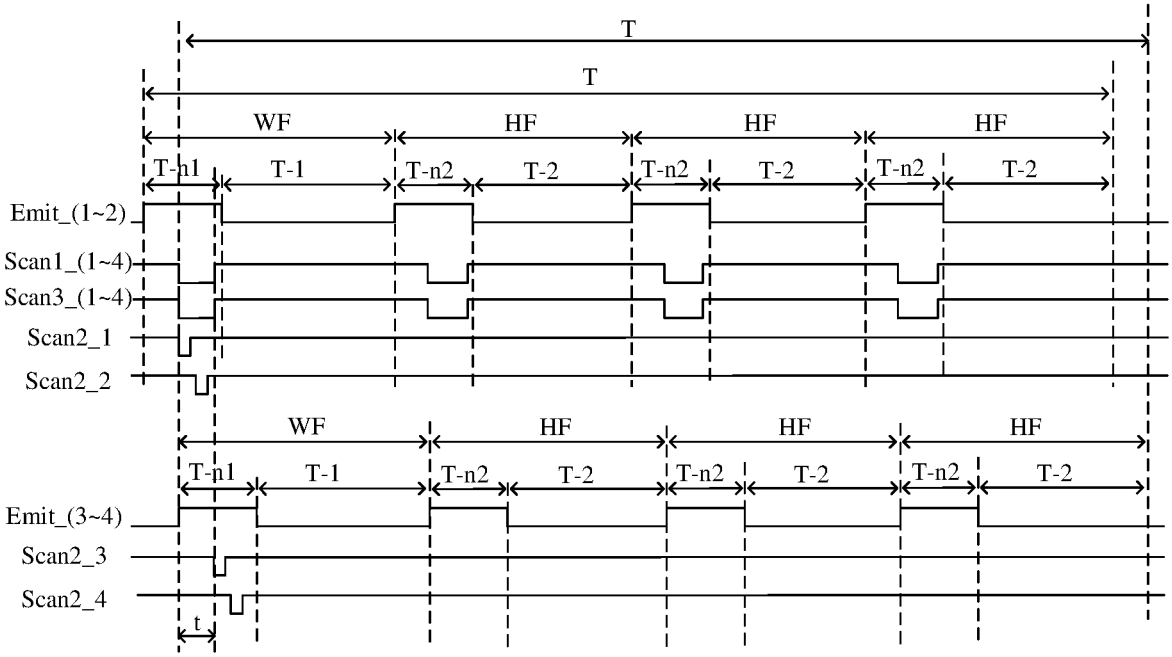
FIG. 21 is a sequence diagram corresponding to FIG. 20.

FIG. 20 is yet another schematic diagram of connection between signal lines and circuit rows 4 according to an embodiment of the present disclosure, and FIG. 21 is a sequence diagram corresponding to FIG. 20; as shown in FIG. 20 and FIG. 21, one light-emission control signal line Emit is electrically connected to the light-emission control modules 5 of the pixel circuits 1 in y circuit rows 4, wherein y is a positive integer greater than or equal to 1.

Moreover, k>y. For example, referring to FIG. 20, x=4, k=4, and y=2. For the k circuit rows 4 electrically connected to the same third scanning signal line Scan3, there is an overlapping range t between non-enable levels of at least two light-emission control signals corresponding to the k circuit rows 4, and the enable level of the third scanning signal is within the overlapping range t.

The foregoing structure can reduce the number of stages of scan shift registers (or scan shift registers and light-emission shift registers) and reduce the space occupied by the shift registers in the bezel area. Moreover, the enable level of the third scanning signal falls within the overlapping range t between the non-enable levels of at least two light-emission control signals, to prevent the low level of the third scanning signal corresponding to a certain pixel circuit 1 from overlapping with the low level of the light-emission control signal corresponding to another pixel circuit 1 in the same column, thereby preventing another pixel circuit 1, when controlling the light-emission element D to emit light, from writing the first reset voltage into the anode of the light-emission element D, thus avoiding affecting normal light emitting of the light-emission element D driven by another pixel circuit 1.

In an optional implementation, referring to FIG. 4 and FIG. 5 again, the pixel circuit 1 further includes a second reset module 8. The second reset module 8 is electrically connected to a fourth scanning signal line Scan4, a second reset signal line Vref2, and the first node N1. The second reset module 8 is configured to write a second reset voltage into the first node N1 in the first non-light-emission period T-n1 in response to an enable level of a fourth scanning signal, such that the first node N1 is reset before being charged.

In addition, in the embodiments of the present disclosure, the first reset voltage $V_{ref1}$ provided by the first reset signal line Vref1 is lower than the second reset voltage $V_{ref2}$ provided by the second reset signal line Vref2, such that the anode of the light-emission element D is reset by using a lower second reset voltage $V_{ref2}$, making the non-light-emission state of the light-emission element D more complete in the first non-light-emission period T-n1 and the second non-light-emission period T-n2, thereby avoiding the flickering caused by light leakage of the light-emission element D.

In addition, it should be further noted that, referring to FIG. 4 and FIG. 17 again, the voltage writing module 2 may specifically include a voltage writing transistor M3, wherein a gate of the voltage writing transistor M3 is electrically connected to the first scanning signal line Scan1, a first electrode of the voltage writing transistor M3 is electrically connected to the data line Data, and a second electrode of the voltage writing transistor M3 is electrically connected to the second node N2.

The threshold compensation module 3 may specifically include a threshold compensation transistor M4, wherein a gate of the threshold compensation transistor M4 is electrically connected to the second scanning signal line Scan2, a first electrode of the threshold compensation transistor M4 is electrically connected to the third node N3, and a second electrode of the threshold compensation transistor M4 is electrically connected to first node N1.

The light-emission control module 5 may specifically include a first light-emission control transistor M5 and a second light-emission control transistor M6. A gate of the first light-emission control transistor M5 is electrically connected to the light-emission control signal line Emit, a first electrode of the first light-emission control transistor M5 is electrically connected to the power signal line PVDD, and a second electrode of the first light-emission control transistor MS is electrically connected to the first node N1. A gate of the second light-emission control transistor M6 is electrically connected to the light-emission control signal line Emit, a first electrode of the second light-emission control transistor M6 is electrically connected to the third node N3, and a second electrode of the second light-emission control transistor 6 is electrically connected to the anode of the light-emission element D.

The first reset module 7 may specifically include a first reset transistor M1, wherein a gate of the first reset transistor M1 is electrically connected to the third scanning signal line Scan3 or the first scanning signal line Scan1, a first electrode of the first reset transistor M1 is electrically connected to the first reset signal line Vref1, and a second electrode of the first reset transistor M1 is electrically connected to the anode of the light-emission element D.

The second reset module 8 may specifically include a second reset transistor M2, wherein a gate of the second reset transistor M2 is electrically connected to the fourth scanning signal line Scan4, a first electrode of the second reset transistor M2 is electrically connected to the second reset signal line Vref2, and a second electrode of the second reset transistor M2 is electrically connected to the first node N1.

In addition, the pixel circuit 1 further includes a storage capacitor Cst. A first plate of the storage capacitor Cst is electrically connected to the power signal line PVDD. A second plate of the storage capacitor Cst is electrically connected to the first node N1.

The operation principle of the transistor has been described in detail above. Details are not described herein again.

Based on the same inventive concept, the embodiments of the present disclosure further provide a driving method for a display panel. The driving method is used for driving the display panel described above. The driving method includes driving each pixel circuit 1 to control a light-emission element D to emit light.

Figure 22:
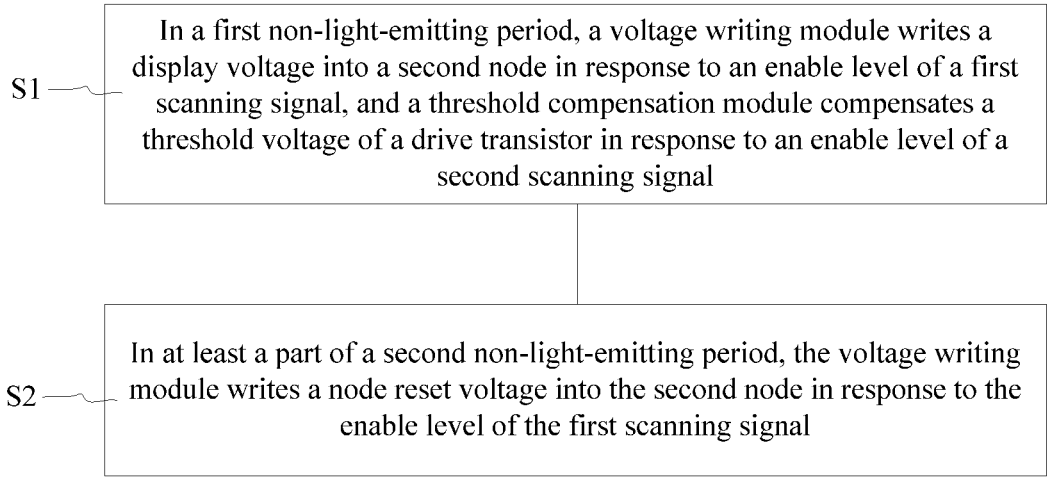
FIG. 22 is a flowchart of a driving method according to an embodiment of the present. invention.

With reference to FIG. 4 and FIG. 5, FIG. 22 is a flowchart of a driving method according to an embodiment of the present disclosure. As shown in FIG. 22, a driving cycle T of the pixel circuit 1 includes a writing phase WF and at least one holding phase HF, wherein the writing phase WF includes a first non-light-emission period T-n1, and the holding phase HF includes a second non-light-emission period T-n2. A driving process of the pixel circuit 1 includes the following steps:

In step S1, in a first non-light-emission period T-n1, a voltage writing module 2 writes a display voltage into a second node N2 in response to an enable level of a first scanning signal, and a threshold compensation module 3 compensates a threshold voltage of a drive transistor M0 in response to an enable level of a second scanning signal.

In step S2, in at least a part of a second non-light-emission period T-n2, the voltage writing module 2 writes a node reset voltage into the second node N2 in response to the enable level of the first scanning signal.

In the embodiments of the present disclosure, the second node N2 is reset at a high frequency by using the voltage writing module 2, such that a node reset voltage V1 which is closer to the display voltage $V_{Data}$ can be written into the second node N2 in at least a part of the second non-light-emission period T-n2 in the holding phase HF, thereby reducing a difference between voltages of the second node N2 in the second non-light-emission period T-n2 and the first non-light-emission period T-n1, and making bias voltages of the drive transistor M0 in the two periods to be consistent. This reduces a difference between brightness rising speeds during early light-emission periods in the writing phase WF and the holding phase HF, thereby effectively alleviating the picture flickering in the case of low-frequency low-grayscale display.

Human eyes are more sensitive to brightness flickering at a frequency below 30 Hz. Therefore, in an optional implementation, an enable frequency of the first scanning signal is f1, and f1 may satisfy the following relationship: f1 ≥30 Hz. For example, when a driving frequency of the display panel (an enable frequency of the second scanning signal) is 15 Hz, the enable frequency of the first scanning signal may be 30 Hz, 45 Hz, 60 Hz, 90 Hz, 120 Hz or the like.

In an optional implementation, referring to FIG. 4 and FIG. 5 again, the pixel circuit 1 further includes a light-emission control module 5, wherein the light-emission control module 5 is electrically connected to the light-emission control signal line Emit, the power signal line PVDD, the second node N2, the third node N3, and the anode of the light-emission element D.

On this basis, the writing phase WF further includes a first light-emission period T-1, and the holding phase HF further includes a second light-emission period T-2. The driving method further includes: in the first light-emission period. T-1 and the second light-emission period T-2, transmitting, by the light-emission control module 5, a driving current to the anode of the light-emission element D in response to an enable level of a light-emission control signal. The enable frequency of the first scanning signal is equal to an enable frequency of the light-emission control signal. In this case, the node reset voltage $V_1$ is written into the second node N2 by using the voltage writing module 2 in each holding phase HF, such that the second node N2 is reset at a higher frequency, thus better alleviating the flickering.

In an optional implementation, the node reset voltage is a fixed voltage. In this case, when the data line Data is required to transmit the node reset voltage, it is only necessary to output a fixed signal to the data line Data by using a driver chip, Chip design is less complex.

Compared with high-grayscale display, the brightness flickering in low-grayscale display is more severe, and the display voltage VData in low-grayscale display generally ranges from 3V to 5V. Therefore, in order to reduce the difference between voltages of the second node N2 in the holding phase HF and the writing phase WF, when the fixed voltage is V1, V1 satisfies the following relationship:

Further, the node reset voltage may be a constant voltage Wimp: alternatively, the node reset voltage may be a voltage corresponding to a specific grayscale value, for example, a grayscale voltage corresponding to a grayscale value of 128.

In an optional implementation, with reference to FIG. 3, FIG. 4, FIG. 8 and FIG. 9, the display panel includes a plurality of circuit rows 4 arranged along a first direction x, each of the circuit rows 4 includes a plurality of pixel circuits 1 arranged along a second direction y, and the first direction x intersects the second direction y. One first scanning signal line Scan1 is electrically connected to the voltage writing modules 2 of the pixel circuits 1 in x circuit rows 4, x being a positive integer greater than or equal to 1.

On this basis, the process of writing, by the voltage writing module 2, the display voltage into the second node N2 in response to the enable level of the first scanning signal includes: writing, by the voltage writing modules 2 in the x circuit rows 4, the display voltage into the second node N2 in response to the enable level of the first scanning signal provided by the same first scanning signal line Scan1.

The process of writing, by the voltage writing module 2, the node reset voltage into the second node N2 in response to the enable level of the first scanning signal includes: writing, by the voltage writing modules 2 in the x circuit rows 4, the node reset voltage into the second node N2 in response to the enable level of the first scanning signal provided by the same first scanning signal line Scan1.

It should be noted that, when x≥2, for the x circuit rows 4 electrically connected to one first scanning signal line Scan1, the enable level of the first scanning signal provided by the first scanning signal line Scan1 overlaps with enable levels of x second scanning signals corresponding to the x circuit rows 4. In other words, the pulse width of the first scanning signal is larger than the pulse width of the second scanning signal, such that the pixel circuits 1 in each circuit row 4 cart charge the first node N1 in the first non-light-emission period T-n1 of the respective driving cycle T.

Based on the foregoing driving method, one first scanning signal line Scan1 can drive pixel circuits 1 in a plurality of circuit rows 4, which reduces the number of stages of scan shift registers for outputting signals to the first scanning signal line Scan1, thereby reducing the space occupied by the scan shift registers in the bezel area.

Further, with reference to FIG. 3, FIG. 4, FIG. 8 and FIG. 9, the pixel circuit 1 further includes a light-emission control module 5, wherein the light-emission control module 5 is electrically connected to the light-emission control signal line Emit, the power signal line PVDD, the second node N2, the third node N3, and the anode of the light-emission element D. One light-emission control signal line Emit is electrically connected to the light-emission control modules 5 of the pixel circuits 1 in y circuit rows 4, y being a positive integer greater than or equal to 1.

On this basis, the writing phase WF further includes a first light-emission period T-1, the holding phase HF further includes a second light-emission period T-2, and the driving method further includes: in the first light-emission period T-1 and the second light-emission period T-2, transmitting, by the light-emission control nodules 5 in the x circuit rows 4, a driving current to the anode of the light-emission element D in response to the enable level of the light-emission control signal provided by the same light-emission control signal line Emit.

Based on the foregoing driving method, one light-emission control signal line Emit can drive pixel circuits 1 in a plurality of circuit rows 4, which reduces the number of stages of light-emission shift registers for outputting signals to the light-emission control signal line Emit, thereby reducing the space occupied by the light-emission shift registers in the bezel area.

In an optional implementation, referring to FIG. 8 and FIG. 9 again, x=y, and x≥2. That is, one light-emission control signal line Emit and one first scanning signal line Scant ate electrically connected to the same x circuit rows 4.

In this case, it is only necessary to make the non-enable levels of the light-emission control signals corresponding to the x circuit rows 4 cover the enable level of the first scanning signal. The control method for signal output is easier, while the number of stages of the light-emission shift registers and scan shift registers is also reduced, thereby further reducing the bezel width of the display panel.

In an optional implementation, referring to FIG. 10 and FIG. 11 again, x=y. The display panel further includes control modules 6, wherein control terminals of the control modules 6 are electrically connected to the light-emission control signal lines Emit, input terminals of the control modules 6 are electrically connected to first fixed potential signal lines VGL, the first fixed potential signal lines VGL are used for providing the enable levels of the first scanning signals, and output terminals of the control modules 6 are electrically connected to the first scanning signal lines Scan1. The first scanning signal line Scan1 and the light-emission control signal line Emit electrically connected to the same control module 6 are electrically connected to the same x circuit rows 4.

On this basis, the process of writing, by the voltage writing modules 2 in the x circuit rows 4, the display voltage into the second node N2 in response to the enable level of the same first scanning signal includes: providing, by the control module 6, an enable level to the first scanning signal line Scan1 in response to a non-enable level of the light-emission control signal, such that the voltage writing modules 2 in the x circuit rows 4 write the display voltage into the second node N2 in response to the enable level of the first scanning signal.

The process of writing, by the voltage writing modules 2 in the x circuit rows 4, the node reset voltage into the second node N2 in response to the enable level of the same first scanning signal includes: providing, by the control module 6, an enable level to the first scanning signal line Scan1 in response to a non-enable level of the light-emission control signal, such that the voltage writing modules 2 in the circuit rows 4 write the node reset voltage into the second node N2 in response to the enable level of the first scanning signal.

In the foregoing driving method, the output of the first scanning signal only needs to be controlled by the light-emission control signal, and it is unnecessary to set a separate scan shift register corresponding to the first scanning signal line Scan1, which further simplifies the structure of the display panel and reduces the bezel width. Moreover, in such a configuration, the enable frequency of the first scanning signal is the same as that of the light-emission control signal, and the second node N2 can be reset in each holding phase HF. The node is reset at a higher frequency, thereby achieving a better improvement effect for the bias voltage of the drive transistor M0.

In an optional implementation, referring to FIG. 12 and FIG. 13 again, x>y. Moreover, for the x circuit rows 4 electrically connected to the same first scanning signal line Scan1, there is an overlapping range t between non-enable levels of at least two light-emission control signals corresponding to the x circuit rows 4, and the enable level of the first scanning signal is within the overlapping range t.

The enable level of the first scanning signal falls within the overlapping range t between the non-enable levels of at least two light-emission control signals, to prevent the low level of the first scanning signal corresponding to a certain pixel circuit 1 from overlapping with the low level of the light-emission control signal corresponding to another pixel circuit 1 in the same column, thereby preventing another pixel circuit 1, when controlling the light-emission element 1) to emit light, from writing the node reset voltage into the second node N2, thus avoiding affecting normal light emitting of the light-emission element D driven by another pixel circuit 1.

In an optional implementation, referring to FIG. 4 and FIG. 5 again, the pixel circuit 1 further includes a first reset module 7, and the first reset module 7 is electrically connected between a first reset signal line Vref1 and the first node N1.

On this basis, the driving method further includes: in the first non-light-emission period T-n1 and at least a part of the second non-light-emission period T-n2, writing, by the first reset module 7, a first reset voltage into the anode of the light-emission element D in response to an enable level of a third scanning signal.

In the second non-light-emission period T-n2 of the holding phase HF, the anode of the light-emission element D is reset at a high frequency, to force the potential of the anode of the light-emission element D down, such that the brightness of the picture displayed by the display panel also has a valley in the second non-light-emission period T-n2 of the holding phase HF; the brightness valley has a high occurrence frequency, making the brightness changes at such a frequency unperceivable to human eyes.

Further, an enable frequency of the third scanning signal is f2, wherein f2≥30 Hz, to further reduce the risk of the brightness flickering being perceived by human eyes.

In an optional implementation, referring to FIG. 17, the first scanning signal line Scan1 is further used for providing the third scanning signal, and the first reset module 7 is electrically connected to the first scanning signal line Scan1.

On this basis, the process of writing, by the first reset module 7, the first reset voltage into the anode of the light-emission element D in response to the enable level of the third scanning signal includes: writing, by the first reset module 7, the first reset voltage into the anode of the light-emission element D in response to the enable level of the third scanning signal provided by the first scanning signal line Scan1.

In this case, both the third scanning signal and the first scanning signal are provided by the first scanning signal line Scan1; an enable frequency of the third scanning signal is the same as the enable frequency of the first scanning signal. It is unnecessary to arrange an additional scanning signal line for providing the third scanning signal, thereby reducing the wiring complexity.

Alternatively, in another optional implementation, referring to FIG. 4 and FIG. 5 again, the first reset module 7 is electrically connected to a third scanning signal line Scan3 for providing the third scanning signal.

On this basis, the process of writing, by the first reset module 7, the first reset voltage into the anode of the light-emission element. D in response to the enable level of the third scanning signal includes: writing, by the first reset module 7, the first reset voltage into the anode of the light-emission element D in response to the enable level of the third scanning signal provided by the third scanning signal line Scan3.

In this case, the first reset module 7 and the voltage writing module 2 are electrically connected to different scanning signal lines. The frequency of resetting the anode of the light-emission element D may be the same as or different from the frequency of resetting the second node N2, and the control method is more flexible.

In an optional implementation, referring to FIG. 20 and FIG. 21 again, the display panel includes a plurality of circuit rows 4 arranged along a first direction x, each of the circuit rows 4 includes a plurality of pixel circuits 1 arranged along a second direction y, and the first direction x intersects the second direction y. One third scanning signal line Scan3 is electrically connected to the first reset modules 7 of the pixel circuits 1 in k circuit rows 4, k being a positive integer greater than or equal to 1. One light-emission control signal line Emit is electrically connected to the light-emission control modules 5 of the pixel circuits 1 in y circuit rows 4, y being a positive integer greater than or equal to 1, wherein k>y.

On this basis, the process of writing, by the first reset module 7, the first reset voltage into the anode of the light-emission element D in response to the enable level of the third scanning signal provided by the third scanning signal lines Scan3 includes: writing, by the first reset modules 7 in the k circuit rows 4, the first reset voltage into the anode of the light-emission element D in response to the enable level of the third scanning signal provided by the same third scanning signal line Scan3.

The writing phase WF further includes a first light-emission period T-1, the holding phase HF further includes a second light-emission period T-2, and the driving method further includes: in the first light-emission period T-1 and the second light-emission period T-2, transmitting, by the light-emission control modules 5 in the y circuit rows 4, a driving current to the anode of the light-emission element D in response to the enable level of the light-emission control signal provided by the same light-emission control signal line Emit.

For the k circuit rows 4 electrically connected to the same third scanning signal line Scan3, there is an overlapping range t between non-enable levels of at least two light-emission control signals corresponding to the k circuit rows 4, and the enable level of the third scanning signal is within the overlapping range t.

The foregoing driving method can reduce the number of stages of scan shift registers (or scan shift registers and light-emission shift registers) and reduce the space occupied by the shift registers in the bezel area. Moreover, the enable level of the third scanning signal falls within the overlapping range t between the non-enable levels of at least two light-emission control signals, to prevent the low level of the third scanning signal corresponding to a certain pixel circuit 1 from overlapping with the low level of the light-emission control signal corresponding to another pixel circuit 1 in the same column, thereby preventing another pixel circuit 1, when controlling the light-emission element D to emit light, from writing the first reset voltage into the anode of the light-emission element D, thus avoiding affecting normal light emitting of the light-emission element D driven by another pixel circuit 1.

In an optional implementation, referring to FIG. 4 and FIG. 5 again, the pixel circuit 1 further includes a second reset module 8, wherein the second reset module 8 is electrically connected to a fourth scanning signal line Scan4, a second reset signal line Vref2, and the first node N1.

On this basis, the driving method further includes: in the first non-light-emission period T-n1, writing, by the second reset module 8, a second reset voltage into the first node N1 in response to an enable level of a fourth scanning signal, such that the first node N1 is reset before being charged.

In addition, in the embodiments of the present disclosure, the first reset voltage $V_{ref1}$ provided by the first reset signal line Vref1 is lower than the second reset voltage $V_{ref2}$ provided by the second reset signal line Vref2, such that the anode of the light-emission element D is reset by using a lower second reset voltage $V_{ref2}$, making the non-light-emission state of the light-emission element D more complete in the first non-light-emission period T-n1 and the second non-light-emission period T-n2, thereby avoiding the flickering caused by light leakage of the light-emission element D.

Figure 23:
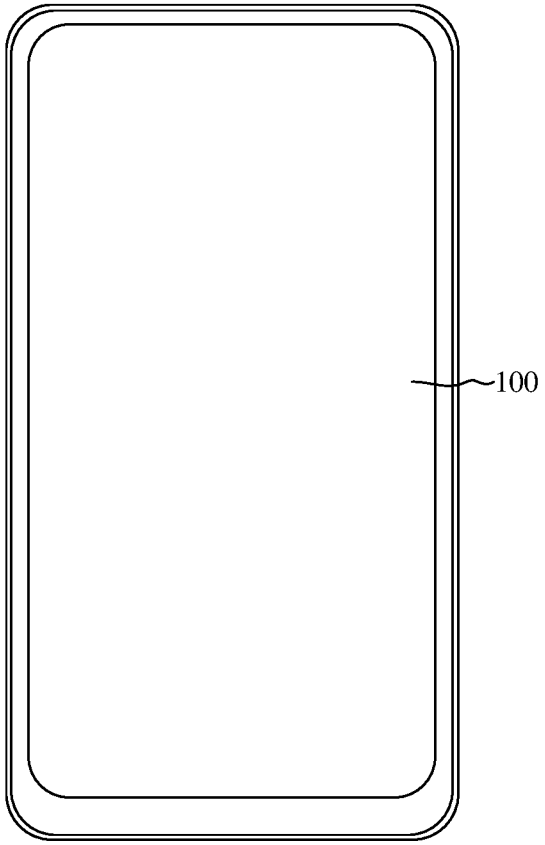
FIG. 23 is a schematic structural diagram of a display apparatus according to an embodiment of the present disclosure.

Based on the same inventive concept, the embodiments of the present disclosure further provide a display apparatus. FIG. 23 is a schematic structural diagram of a display apparatus according to an embodiment of the present disclosure. As shown in FIG. 23, the display apparatus includes the foregoing display panel 100. The specific structure of the display panel 100 has been described in detail in the foregoing embodiments. Details are not described herein again. Certainly, the display apparatus shown in FIG. 23 is for schematic description only. The display apparatus may be any electronic device with a display function, such as a mobile phone, a tablet computer, a notebook computer, an ebook, or a television.

The above descriptions are merely preferred embodiments of the present invention, and are not intended to limit the present invention. Any modifications, equivalent replacements, improvements, and the like made within the spirit and principle of the present invention shall fall within the protection scope of the present invention.

Finally, it should be noted that the above embodiments are merely intended to describe the technical solutions of the present disclosure, rather than to limit the present disclosure. Although the present disclosure is described in detail with reference to the above embodiments, persons of ordinary skill in the art should understand that they may still make modifications to the technical solutions described in the above embodiments or make equivalent replacements to some or all technical features thereof, without departing from the essence of the technical solutions in the embodiments of the present disclosure.

What is claimed is:

1. A display panel, comprising a plurality of pixel circuits, wherein each of the plurality of pixel circuits comprises:

a drive transistor, comprising a gate electrically connected to a first node, a first electrode electrically connected to a second node, and a second electrode electrically connected to a third node;

a voltage writing circuit, electrically connected to a first scanning signal line, a data line, and the second node, respectively; and a threshold compensation circuit, electrically connected to a second scanning signal line, the third node, and the first node, respectively;

wherein a driving cycle of each of the plurality of the pixel circuits comprises a writing phase and at least one holding phase, the writing phase comprises a first non-light-emission period, and the at least one holding phase comprises a second non-light-emission period;

wherein the voltage writing circuit is configured to write a display voltage into the second node in the first non-light-emission period in response to an enable level of a first scanning signal, and write a node reset voltage into the second node in at least part of the second non-light-emission period in response to the enable level of the first scanning signal; and wherein the threshold compensation circuit is configured to compensate for a threshold voltage of the drive transistor in the first non-light-emission period in response to an enable level of a second scanning signal, and the display panel further comprising a plurality of circuit rows arranged along a first direction, wherein each circuit row of the plurality of circuit rows comprises pixel circuits arranged along a second direction, and the first direction intersects the second direction; and wherein one first scanning signal line is electrically connected to voltage writing circuits of the pixel circuits in x circuit rows of the plurality of circuit rows, x being a positive integer greater than or equal to 1.

2. The display panel according to claim 1, wherein each of the plurality of pixel circuits further comprises a light-emission control circuit, which is electrically connected to a light-emission control signal line, a power signal line, the second node, the third node, and an anode of a light-emission element;

wherein the writing phase further comprises a first light-emission period; the at least one holding phase further comprises a second light-emission period; the light-emission control circuit is configured to transmit a driving current to the anode of the light-emission element in the first light-emission period and in the second light-emission period in response to an enable level of a light-emission control signal; and wherein one light-emission control signal line is electrically connected to light-emission control circuits of the pixel circuits in y circuit rows of the plurality of circuit rows, y being a positive integer greater than or equal to 1.

3. The display panel according to claim 2, wherein x=y, and x>2.

4. The display panel according to claim 2, wherein x=y;

the display panel further comprises a control circuit; a control terminal of the control circuit is electrically connected to the light-emission control signal line; an input terminal of the control circuit is electrically connected to a first fixed potential signal line, and the first fixed potential signal line is used for providing the enable level of the first scanning signal; and an output terminal of the control circuit is electrically connected to the first scanning signal line; and the first scanning signal line and the light-emission control signal line electrically connected to a same control circuit are electrically connected to a same x circuit rows of the plurality of circuit rows.

5. The display panel according to claim 4, wherein the control circuit comprises a control transistor, a gate of the control transistor is electrically connected to the light-emission control signal line, a first electrode of the control transistor is electrically connected to the first fixed potential signal line, and a second electrode of the control transistor is electrically connected to the first scanning signal line.

6. The display panel according to claim 2, wherein x>y; and for the x circuit rows of the plurality of circuit rows electrically connected to a same first scanning signal line, an overlapping range exists between non-enable levels of at least two light-emission control signals corresponding to the x circuit rows of the plurality of circuit rows, and the enable level of the first scanning signal is within the overlapping range.

7. The display panel according to claim 1, wherein each of the plurality of pixel circuits further comprises a first reset circuit, and the first reset circuit is electrically connected between the first reset signal line and an anode of a light-emission element; and the first reset circuit is configured to write a first reset voltage into the anode of the light-emission element in the first non-light-emission period and in at least a part of the second non-light-emission period in response to an enable level of a third scanning signal.

8. The display panel according to claim 7, wherein the first scanning signal line is further used for providing the third scanning signal, and the first reset circuit is electrically connected to the first scanning signal line.

9. The display panel according to claim 7, wherein the first reset circuit is electrically connected to a third scanning signal line for providing the third scanning signal.

10. The display panel according to claim 9, wherein the display panel comprises the plurality of circuit rows arranged along the first direction, each circuit row of the plurality of circuit rows comprises pixel circuits arranged along the second direction, and the first direction intersects the second direction; and the third scanning signal line is electrically connected to the first reset circuit of the pixel circuit in k of the plurality of circuit rows respectively, k is a positive integer greater than or equal to 1.

11. The display panel according to claim 10, wherein each of the plurality of pixel circuits further comprises a light-emission control circuit; the light-emission control circuit is electrically connected to a light-emission control signal line, a power signal line, the second node, the third node, and the anode of the light-emission element; the writing phase further comprises a first light-emission period; the at least one holding phase further comprises a second light-emission period; and the light-emission control circuit is configured to transmit a driving current to the anode of the light-emission element in the first light-emission period and in the second light-emission period in response to an enable level of a light-emission control signal;

one light-emission control signal line is electrically connected to the light-emission control circuits of the pixel circuits in y circuit rows of the plurality of circuit rows, y being a positive integer greater than or equal to 1; and k>y, and for k circuit rows of the plurality of circuit rows electrically connected to a same third scanning signal line, an overlapping range exists between non-enable levels of at least two light-emission control signals corresponding to the k circuit rows of the plurality circuit rows, and the enable level of the third scanning signal is within the overlapping range.

12. The display panel according to claim 1, wherein each of the plurality of pixel circuits further comprises a second reset circuit; the second reset circuit is electrically connected to a fourth scanning signal line, a second reset signal line, and the first node; and the second reset circuit is configured to write a second reset voltage into the first node in the first non-light-emission period in response to an enable level of a fourth scanning signal.

13. A method for driving a display panel comprises a plurality of pixel circuits, wherein each of the plurality of pixel circuits comprises:

a drive transistor, comprising a gate electrically connected to a first node, a first electrode electrically connected to a second node, and a second electrode electrically connected to a third node;

a voltage writing circuit, electrically connected to a first scanning signal line, a data line, and the second node, respectively; and a threshold compensation circuit, electrically connected to a second scanning signal line, the third node, and the first node, respectively;

wherein a driving cycle of each of the plurality of the pixel circuits comprises a writing phase and at least one holding phase, the writing phase comprises a first non-light-emission period, and the at least one holding phase comprises a second non-light-emission period;

wherein the voltage writing circuit is configured to write a display voltage into the second node in the first non-light-emission period in response to an enable level of a first scanning signal, and write a node reset voltage into the second node in at least part of the second non-light-emission period in response to the enable level of the first scanning signal; and wherein the threshold compensation circuit is configured to compensate for a threshold voltage of the drive transistor in the first non-light-emission period in response to an enable level of a second scanning signal;

the display panel further comprising a plurality of circuit rows arranged along a first direction, wherein each circuit row of the plurality of circuit rows comprises pixel circuits arranged along a second direction, and the first direction intersects the second direction; and wherein one first scanning signal line is electrically connected to voltage writing circuits of the pixel circuits in x circuit rows of the plurality of circuit rows, x being a positive integer greater than or equal to 1; and wherein the method comprises driving each of the plurality of pixel circuits to control a light-emission element to emit light, wherein a driving cycle of each of the plurality of pixel circuits comprises the writing phase and the at least one holding phase, the writing phase comprises the first non-light-emission period, and the at least one holding phase comprises the second non-light-emission period;

in the first non-light-emission period, writing, by the voltage writing circuit, the display voltage into the second node in response to the enable level of the first scanning signal; and compensating, by the threshold compensation circuit, for the threshold voltage of the drive transistor in response to the enable level of the second scanning signal; and in at least part of the second non-light-emission period, writing, by the voltage writing circuit, the node reset voltage into the second node in response to the enable level of the first scanning signal.

14. The method according to claim 13, wherein an enable frequency f1 of the first scanning signal satisfies f1>30 Hz.

15. The method according to claim 13, wherein each of the plurality of pixel circuits further comprises a light-emission control circuit; and the light-emission control circuit is electrically connected to a light-emission control signal line, a power signal line, the second node, a third node, and an anode of a light-emission element, respectively; and the writing phase further comprises a first light-emission period, the at least one holding phase further comprises a second light-emission period, and the driving method further comprises: transmitting, by the light-emission control circuit, a driving current to the anode of the light-emission element in the first light-emission period and in the second light-emission period in response to an enable level of the light-emission control signal;

wherein an enable frequency of the first scanning signal is equal to an enable frequency of the light-emission control signal.

16. The method according to claim 13, wherein the node reset voltage is a fixed voltage.

17. The method according to claim 16, wherein the fixed voltage is V1, and 3V<V1<5V.

18. The method according to claim 13, wherein the display panel comprises the plurality of circuit rows arranged along the first direction, each circuit row of the plurality of circuit rows comprises pixel circuits arranged along a second direction, and the first direction intersects the second direction; and the first scanning signal line is electrically connected to the voltage writing circuits of the pixel circuits in x circuit rows of the plurality of circuit rows, x being a positive integer greater than or equal to 1;

the writing, by the voltage writing circuit, the display voltage into the second node in response to the enable level of the first scanning signal comprises: writing, by the voltage writing circuits in x circuit rows of the plurality of circuit rows, the display voltage into the second node in response to the enable level of the first scanning signal provided by a same first scanning signal line; and the writing, by the voltage writing circuit, the node reset voltage into the second node in response to the enable level of the first scanning signal comprises: writing, by the voltage writing circuits in x circuit rows of the plurality of circuit rows, the node reset voltage into the second node in response to the enable level of the first scanning signal provided by the same first scanning signal line.

19. The method according to claim 13, wherein each of the plurality of pixel circuits further comprises a first reset circuit, and the first reset circuit is electrically connected between a first reset signal line and the first node; and the method further comprises:

in the first non-light-emission period and in at least part of the second non-light-emission period, writing, by the first reset circuit, a first reset voltage into an anode of the light-emission element in response to an enable level of a third scanning signal.

20. The method according to claim 13, wherein each of the plurality of pixel circuits further comprises a second reset circuit, and the second reset circuit is electrically connected to a fourth scanning signal line, a second reset signal line, and the first node, respectively; and the method further comprises:

in the first non-light-emission period, writing, by the second reset circuit, a second reset voltage into the first node in response to an enable level of a fourth scanning signal.

21. A display apparatus, comprising a display panel, wherein the display panel comprises a plurality of pixel circuits, and each of the plurality of pixel circuits comprises:

a drive transistor, comprising a gate electrically connected to a first node, a first electrode electrically connected to a second node, and a second electrode electrically connected to a third node;

a voltage writing circuit, electrically connected to a first scanning signal line, a data line, and the second node, respectively; and a threshold compensation circuit, electrically connected to a second scanning signal line, the third node, and the first node, respectively;

wherein a driving cycle of each of the plurality of the pixel circuits comprises a writing phase and at least one holding phase, the writing phase comprises a first non-light-emission period, and the at least one holding phase comprises a second non-light-emission period;

the voltage writing circuit is configured to write a display voltage into the second node in the first non-light-emission period in response to an enable level of a first scanning signal, and write a node reset voltage into the second node in at least part of the second non-light-emission period in response to the enable level of the first scanning signal; and the threshold compensation circuit is configured to compensate for a threshold voltage of the drive transistor in the first non-light-emission period in response to an enable level of a second scanning signal;

the display panel further comprising a plurality of circuit rows arranged along a first direction, wherein each circuit row of the plurality of circuit rows comprises pixel circuits arranged along a second direction, and the first direction intersects the second direction; and wherein one first scanning signal line is electrically connected to voltage writing circuits of the pixel circuits in x circuit rows of the plurality of circuit rows, x being a positive integer greater than or equal to 1.

* * * * *